US011501726B2

(12) United States Patent
Murai et al.

(10) Patent No.: US 11,501,726 B2
(45) Date of Patent: Nov. 15, 2022

(54) LIQUID CRYSTAL DISPLAY DEVICE

(71) Applicant: SHARP KABUSHIKI KAISHA, Sakai (JP)

(72) Inventors: Takayuki Murai, Sakai (JP); Makoto Shiomi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/374,249

(22) Filed: Jul. 13, 2021

(65) Prior Publication Data

US 2022/0044647 A1 Feb. 10, 2022

(30) Foreign Application Priority Data

Aug. 5, 2020 (JP) ..... JP2020-133154

(51) Int. Cl.
*G09G 3/36* (2006.01)

(52) U.S. Cl.
CPC ..... *G09G 3/3607* (2013.01); *G09G 2310/027* (2013.01); *G09G 2320/0252* (2013.01)

(58) Field of Classification Search
CPC ..... G09G 3/3607; G09G 2310/027; G09G 2320/0252
See application file for complete search history.

(56) References Cited

U.S. PATENT DOCUMENTS

2008/0007514 A1* 1/2008 Tanaka ..... G09G 3/3406 345/102
2012/0086737 A1 4/2012 Tanaka
2019/0064559 A1 2/2019 Harada et al.

FOREIGN PATENT DOCUMENTS

JP 4201026 B2 12/2008
JP 2019-039982 A 3/2019

* cited by examiner

*Primary Examiner* — Kenneth B Lee, Jr.
(74) *Attorney, Agent, or Firm* — ScienBiziP, P.C.

(57) ABSTRACT

A liquid crystal display device includes a backlight, a first liquid crystal panel, a second liquid crystal panel, and a driver. The second liquid crystal panel is overlapped with the first liquid crystal panel, and disposed closer to the backlight than to the first liquid crystal panel. The driver is configured to drive the backlight, the first liquid crystal panel, and the second liquid crystal panel. The second liquid crystal panel is lower in resolution than the first liquid crystal panel. The driver drives the first liquid crystal panel and the second liquid crystal panel at different refresh rates.

10 Claims, 23 Drawing Sheets

DISPLAY PANEL: DARK→BRIGHT
LIGHT-CONTROL PANEL: BRIGHT→DARK

LIQUID CRYSTAL DISPLAY DEVICE

CROSS-REFERENCE TO RELATED APPLICATION

The present application claims priority from Japanese Patent Application Number 2020-133154, the content to which is hereby incorporated by reference into this application.

BACKGROUND OF THE INVENTION

1. Field of the Invention

The present invention relates to a liquid crystal display device.

2. Description of the Related Art

One of conventionally known techniques to improve in-plane contrast of a liquid crystal display (LCD) is to produce the LCD to include a plurality of liquid crystal panels stacked on top of another. For example, a display device disclosed in Japanese Unexamined Patent Application Publication No. 2019-039982 uses two liquid crystal panels having the same resolution. Moreover, a liquid crystal display device disclosed in Japanese Patent No. 4201026 drives two liquid crystal panels with different driving methods.

However, the above conventionally known techniques have problems below. For example, when a pixel of an liquid crystal display switches from a grayscale level of 255/255 to 0/255, the grayscale level of the liquid crystal fails to fall to a transmittance as low as the grayscale level of 0/255 because of slow response of the liquid crystal. Consequently, the pixel cannot achieve desired brightness. That is why a phenomenon referred to as motion blur occurs. When two liquid crystal panels are stacked together, the motion blur occurs in each of the panels such that the effect of the slow response speed is inevitably squared.

An aspect of the present invention is intended to provide a technique capable of improving in-plane contrast and simultaneously reducing a decrease in response speed.

In order to solve the above problems, a liquid crystal display device according to an aspect of the present invention includes: a backlight; a first liquid crystal panel; a second liquid crystal panel overlapped with the first liquid crystal panel, and disposed closer to the backlight than to the first liquid crystal panel; and a driver configured to drive the backlight, the first liquid crystal panel, and the second liquid crystal panel. The second liquid crystal panel is lower in resolution than the first liquid crystal panel. The driver drives the first liquid crystal panel and the second liquid crystal panel at different refresh rates.

In the liquid crystal display device according to an aspect of the present invention, the driver drives the second liquid crystal panel at a refresh rate higher than a refresh rate of the first liquid crystal panel.

In the liquid crystal display device according to an aspect of the present invention, the driver determines pixel values of a plurality of pixels included in the second liquid crystal panel, with reference to pixel values of a plurality of pixels included in the first liquid crystal panel and corresponding to the pixels in the second liquid crystal panel.

In the liquid crystal display device according to an aspect of the present invention, the driver drives the second liquid crystal panel to compensate for a response speed of the first liquid crystal panel.

In the liquid crystal display device according to an aspect of the present invention, when the driver: (i) supplies a pixel, included in the first liquid crystal panel, with a signal having a grayscale value lower in a second frame than in a first frame, the second frame immediately succeeding the first frame, and (ii) supplies an other pixel, included in the second liquid crystal panel and corresponding to the pixel in the first liquid crystal panel, with a signal having a grayscale value lower in the second frame than in the first frame, the driver supplies the other pixel, included in the second liquid crystal panel and corresponding to the pixel in the first liquid crystal panel, with a signal having a grayscale value lower in a first sub-frame, included in the second frame, than in a second sub-frame succeeding the first sub-frame.

In the liquid crystal display device according to an aspect of the present invention, when the driver: (i) supplies a pixel, included in the first liquid crystal panel, with a signal having a grayscale higher in a second frame than in a first frame, the second frame immediately succeeding the first frame, and (ii) supplies an other pixel, included in the second liquid crystal panel and corresponding to the pixel in the first liquid crystal panel, with a signal having a grayscale value higher in the second frame than in the first frame, the driver supplies the other pixel, included in the second liquid crystal panel and corresponding to the pixel in the first liquid crystal panel, with a signal having a grayscale value higher in a first sub-frame, included in the second frame, than in a second sub-frame succeeding the first sub-frame.

In the liquid crystal display device according to an aspect of the present invention, when the driver: (i) supplies a pixel, included in the first liquid crystal panel, with a signal having a grayscale value lower in a second frame than in a first frame, the second frame immediately succeeding the first frame, and (ii) supplies an other pixel, included in the second liquid crystal panel and corresponding to the pixel in the first liquid crystal panel, with a signal having a grayscale value higher in the second frame than in the first frame, the driver supplies the other pixel, included in the second liquid crystal panel and corresponding to the pixel in the first liquid crystal panel, with a signal having a grayscale value lower in a first sub-frame, included in the second frame, than in a second sub-frame succeeding the first sub-frame.

In the liquid crystal display device according to an aspect of the present invention, when the driver: (i) supplies a pixel, included in the first liquid crystal panel, with a signal having a grayscale value higher in a second frame than in a first frame, the second frame immediately succeeding the first frame, and (ii) supplies an other pixel, included in the second liquid crystal panel and corresponding to the pixel in the first liquid crystal panel, with a signal having a grayscale value lower in the second frame than in the first frame, the driver supplies the other pixel, included in the second liquid crystal panel and corresponding to the pixel in the first liquid crystal panel, with a signal having a grayscale value higher in a first sub-frame, included in the second frame, than in a second sub-frame succeeding the first sub-frame.

In the liquid crystal display device according to an aspect of the present invention, the driver drives the first liquid crystal panel at a refresh rate higher than a refresh rate of the second liquid crystal panel.

In the liquid crystal display device according to an aspect of the present invention, the driver drives the first liquid crystal panel to compensate for a response speed of the second liquid crystal panel.

In the liquid crystal display device according to an aspect of the present invention, when the driver: (i) supplies a pixel, included in the first liquid crystal panel, with a signal having a grayscale value lower in a second frame than in a first frame, the second frame immediately succeeding the first frame, and (ii) supplies an other pixel, included in the second liquid crystal panel and corresponding to the pixel in the first liquid crystal panel, with a signal having a grayscale value lower in the second frame than in the first frame, the driver supplies the pixel in the first liquid crystal panel with a signal having a grayscale value lower in a first sub-frame, included in the second frame, than in a second sub-frame succeeding the first sub-frame.

In the liquid crystal display device according to an aspect of the present invention, when the driver: (i) supplies a pixel, included in the first liquid crystal panel, with a signal having a grayscale value higher in a second frame than in a first frame, the second frame immediately succeeding the first frame, and (ii) supplies an other pixel, included in the second liquid crystal panel and corresponding to the pixel in the first liquid crystal panel, with a signal having a grayscale value higher in the second frame than in the first frame, the driver supplies the pixel in the first liquid crystal panel with a signal having a grayscale value higher in a first sub-frame, included in the second frame, than in a second sub-frame succeeding the first sub-frame.

In the liquid crystal display device according to an aspect of the present invention, when the driver: (i) supplies a pixel, included in the first liquid crystal panel, with a signal having a grayscale value higher in a second frame than in a first frame, the second frame immediately succeeding the first frame, and (ii) supplies an other pixel, included in the second liquid crystal panel and corresponding to the pixel in the first liquid crystal panel, with a signal having a grayscale value lower in the second frame than in the first frame, the driver supplies the pixel in the first liquid crystal panel with a signal having a grayscale value lower in a first sub-frame, included in the second frame, than in a second sub-frame succeeding the first sub-frame.

In the liquid crystal display device according to an aspect of the present invention, when the driver: (i) supplies a pixel, included in the first liquid crystal panel, with a signal having a grayscale value lower in a second frame than in a first frame, the second frame immediately succeeding the first frame, and (ii) supplies an other pixel, included in the second liquid crystal panel and corresponding to the pixel in the first liquid crystal panel, with a signal having a grayscale value higher in the second frame than in the first frame, the driver supplies the pixel in the first liquid crystal panel with a signal having a grayscale value higher in a first sub-frame, included in the second frame, than in a second sub-frame succeeding the first sub-frame.

An aspect of the present invention is capable of improving in-plane contrast and simultaneously reducing a decrease in response speed.

DETAILED DESCRIPTION OF THE INVENTION

First Embodiment

Described below in detail is an embodiment of the present invention, with reference to FIGS. 1 to 5.

Figure 1:
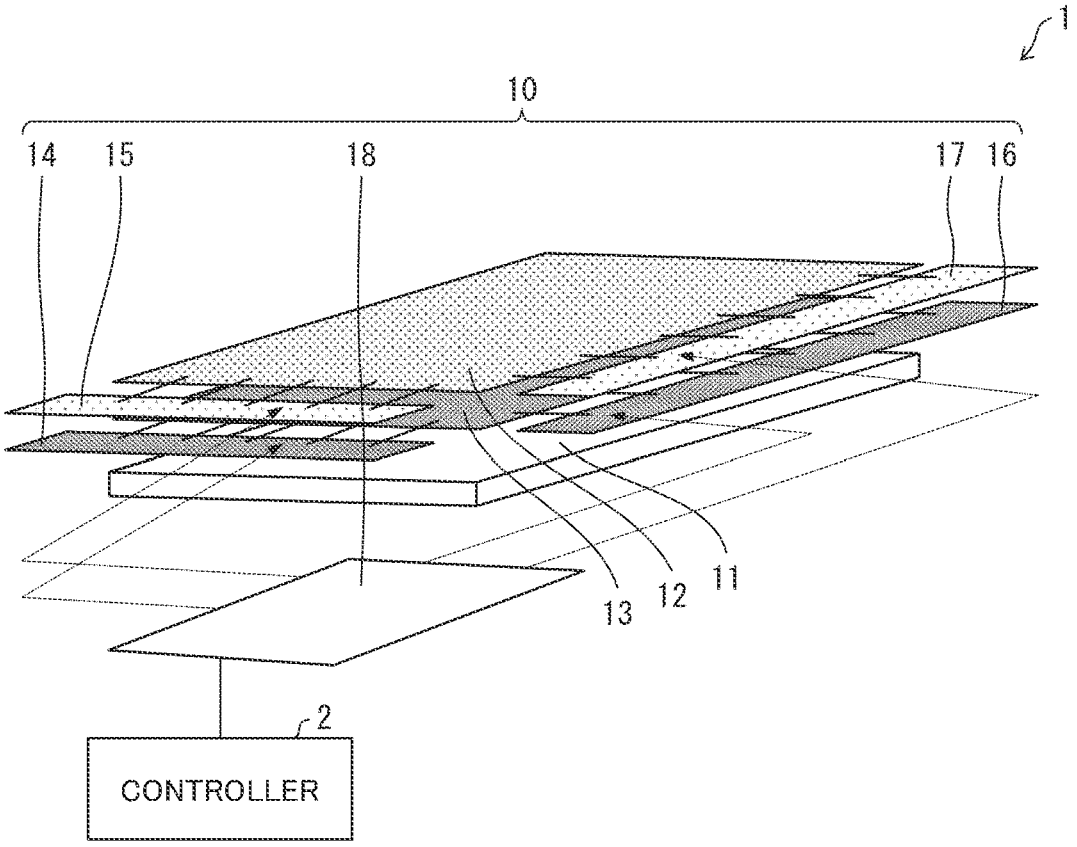
FIG. 1 is a schematic view illustrating an example of a positional relationship among main features of a liquid crystal display device according to a first embodiment of the present invention.

Positional Relationship Among Main Features of Liquid Crystal Display Device FIG. 1 is a schematic view illustrating an example of a positional relationship among main features of a liquid crystal display device 1 according to this embodiment. As illustrated in FIG. 1, the liquid crystal display device 1 includes: a backlight 11 acting as a light source device; a first liquid crystal panel 12; and a second liquid crystal panel 13. In this specification, the first liquid crystal panel 12 and the second liquid crystal panel 13 may respectively be referred to as an image display panel and a light-control panel.

The first liquid crystal panel 12 is surrounded with a scan circuit 15 and a signal output circuit 17. The second liquid crystal panel 13 is surrounded with a scan circuit 14 and a signal output circuit 16. The first and second liquid crystal panels 12 and 13 are electrically connected to the scan circuits 15 and 14 and to the signal output circuits 17 and 16 with a flexible printed circuit or a cable.

The liquid crystal display device 1 includes a controller 2 connected to a signal processor 18. In this specification, the scan circuits 15 and 14, the signal output circuits 17 and 16, and the signal processor 18 may collectively be referred to as a driver 10.

These main features will further be described below with reference to FIG. 1. As illustrated in FIG. 1, the second liquid crystal panel 13 is overlapped with the first liquid crystal panel 12, and disposed closer to the backlight 11 than to the first liquid crystal panel 12.

The driver 10 drives the backlight 11, the first liquid crystal panel 12, and the second liquid crystal panel 13. Although the details are to be described later, the second liquid crystal panel 13 is lower in resolution than the first liquid crystal panel 12, and the driver 10 drives the first liquid crystal panel 12 and the second liquid crystal panel 13 at different refresh rates.

Details of Features of Liquid Crystal Display Device

Figure 2:
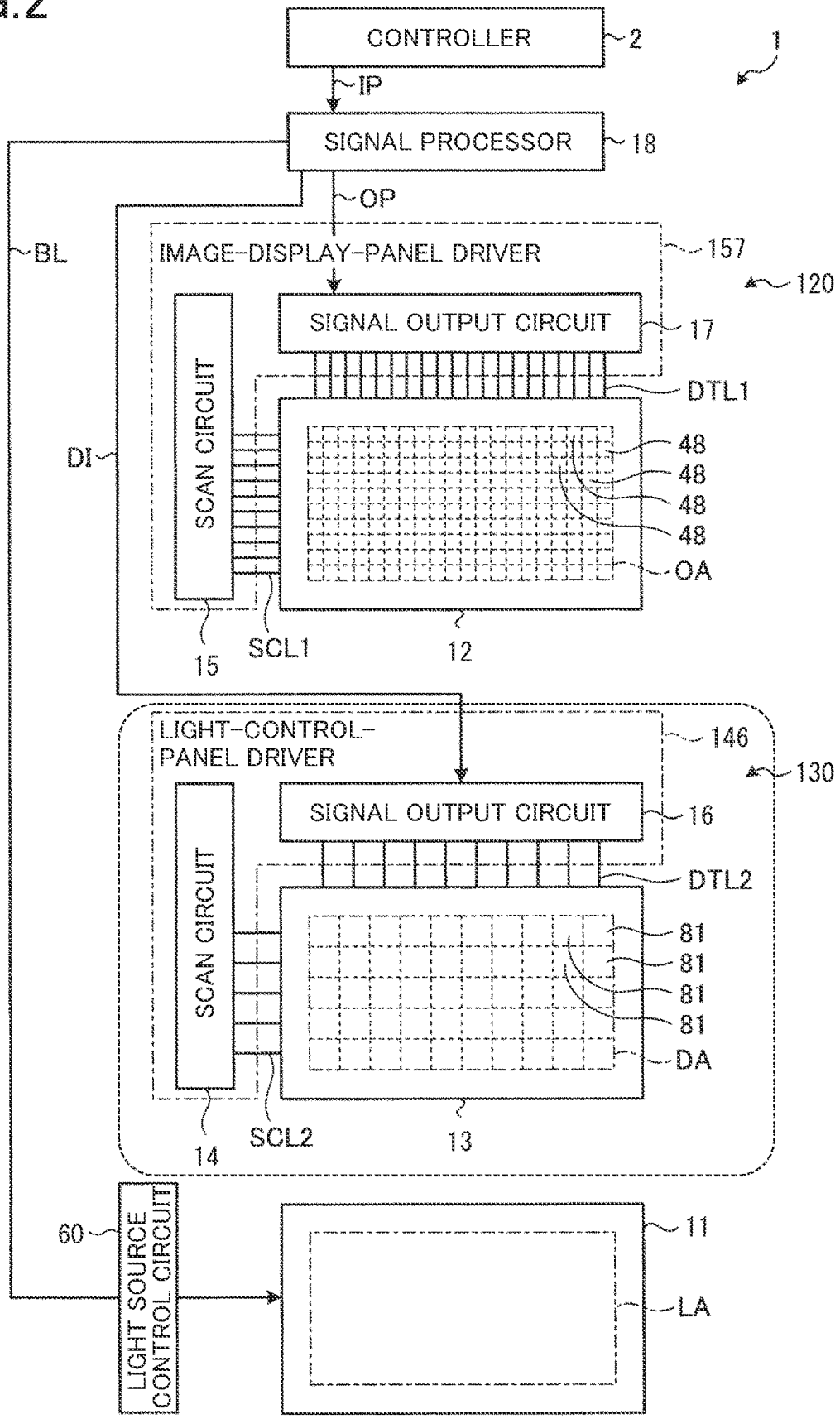
FIG. 2 is a diagram illustrating details of the features of the liquid crystal display device illustrated in FIG. 1.

FIG. 2 is a diagram illustrating details of the features of the liquid crystal display device 1 illustrated in FIG. 1. The liquid crystal display device 1 includes: the signal processor 18; a display unit 120; the light source device 11; a light source control circuit 60; and a light controller 130. The signal processor 18 performs various outputs in accordance with an input picture data item IP to be input from the controller 2 placed outside, and controls operations of the display unit 120, the light source device 11, and the light controller 130.

The input picture data item IP is a signal to act as data to cause the liquid crystal display device 1 to output and display an image. An example of the input picture data item IP is an RGB image signal representing a grayscale value of a pixel 48. Image data to be input to the liquid crystal display device 1 is a group of input picture data items IP each corresponding to one of pixels 48 to be described later.

The signal processor 18 outputs, to the display unit 120, an image-display-panel data item OP generated in accordance with the input picture data item IP. Moreover, the signal processor 18 outputs, to the light controller 130, a light-control-panel data item DI generated in accordance with the input picture data item IP. Furthermore, when receiving the input picture data item IP, the signal processor 18 outputs, to the light source control circuit 60, a backlight data item BL for controlling an amount of light from each of the light sources included in the light source device 11. The light source control circuit 60 is, for example, a driver circuit for turning on the light sources included in the light source device 11, and causes the light source device 11 to operate in accordance with the backlight data item BL.

The display unit 120 includes: an image display panel 12; and an image-display-panel driver 157. The image display panel 12 includes a display region OA provided with the pixels 48. The pixels 48 are arranged, for example, in a matrix.

The image display panel 12 of this embodiment is a liquid-crystal image-display panel. The image-display-panel driver 157 includes: the signal output circuit 17; and the scan circuit 15. The signal output circuit 17 drives the pixels 48 in accordance with the image-display-panel data item OP. The scan circuit 15 outputs a drive signal scanning, in predetermined lines (e.g. in one row), the pixels 48 arranged in a matrix. When the drive signal is output, the pixels 48 are driven to output a grayscale value based on the image-display-panel data item OP.

Each of the pixels 48 includes, for example, three sub-pixels RGB. The sub-pixel R represents a first primary color (e.g. red). The sub-pixel G represents a second primary color (e.g. green). The sub-pixel B represents a third primary color (e.g. blue).

The light controller 130 controls an amount of light emitted from the light source device 11 and output through the display region OA. The light controller 130 includes: the light-control panel 13; and a light-control-panel driver 146. The light-control panel 13 includes a light-control region DA provided with a plurality of divided regions 81.

The light-control region DA is positioned to be overlapped with the display region OA when the display region OA is observed in plan view. The light-control region DA is provided across the entire display region OA in plan view. The divided regions 81 are arranged to change each transmittance of the light. In accordance with the light-control-panel data item DI, the light-control-panel driver 146 individually controls a transmittance of each of the divided regions 81 provided to the light-control region DA.

The divided regions 81 of the light-control panel 13 and the sub-pixels RGB of the image display panel 12 are similar in configuration except for difference in numbers of the divided regions 81 and the sub-pixels RGB. That is, the divided regions 81 change orientations of liquid crystal molecules in a liquid crystal layer of the light-control panel 13 to allow the light to pass through at a transmittance based on a voltage of a signal to be transmitted through a signal line DTL2. Hence, the divided regions 81 are arranged to individually change a transmittance of light. Hence, the light-control region DA is provided with the divided regions 81 each capable of individually adjusting the transmittance of the light.

Moreover, in this embodiment, the light-control panel 13 is lower in resolution than the image display panel 12. In other words, the divided regions 81 of the light-control panel 13 are smaller in total number than the pixels 48 of the image display panel 12.

The light-control panel 13 is stacked above a light-emitting face of the light source device 11 (see also FIG. 1). Moreover, the image display panel 12 is stacked across the light-control panel 13 from the light source device 11.

The light emitted from a lighting region LA is adjusted of light amount in the light-control region DA of the light-control panel 13, and illuminates the image display panel 12. The image display panel 12 has one face (a back face) illuminated from the light source device 11, and an other face (a display face) provided across from the back face and displaying an image.

As can be seen, the light source device 11 functions as a light source including the lighting region LA to emit light from the one face of the image display panel 12 to the display region OA.

As illustrated in FIG. 2, the signal output circuit 17 is electrically connected to the image display panel 12 with a signal line DTL1. The image-display-panel driver 157 selects, with the scan circuit 15, a sub-pixel RGB in the image display panel 12, and controls ON and OFF of a switching element (e.g. a thin-film transistor, or a TFT) for controlling an operation (light transmittance) of the sub-pixel RGB. The scan circuit 15 is electrically connected to the image display panel 12 with a scan line SCL1.

A voltage of a signal to be transmitted through the signal line DTL1 corresponds to a grayscale value indicated by the image-display-panel data item OP. The sub-pixels RGB of each pixel 48 change the orientations of the liquid crystal molecules in the liquid crystal layer to allow the light to pass through at a transmittance based on the voltage of the signal to be transmitted through the signal line DTL1.

The light-control-panel driver 146 includes: a signal output circuit 16; and a scan circuit 14. The signal output circuit 16 is connected through a signal line DTL2 to the divided regions 81 horizontally arranged in FIG. 2. The signal output circuit 14 is connected through a scan line SCL2 to the divided regions 81 vertically arranged in FIG. 2.

The signal output circuit 16 drives the divided regions 81 in accordance with the light-control-panel data item DI to individually control a transmittance of each of the divided regions 81. A voltage of a signal to be transmitted from the signal output circuit 16 through the signal line DTL2 to the divided regions 81 corresponds to a transmittance indicated by the light-control-panel data item DI.

The scan circuit 14 outputs a drive signal scanning, in predetermined lines (e.g. in one row), the divided regions 81 arranged in a matrix. When the drive signal is output, the divided regions 81 are driven to have a transmittance based on the light-control-panel data item DI.

Overall Drive Example of Driver

As can be seen in this embodiment, the driver 10; specifically, the signal processor 18, drives the first liquid crystal panel 12 and the second liquid crystal panel 13 at different refresh rates. As an example, when the input picture data item IP is 120 fps, the driver 10 drives the first liquid crystal panel 12 at a refresh rate of 120 Hz and the second liquid crystal panel 13 at a refresh rate of 240 Hz.

Note that the refresh rate shall not be limited to 240 Hz for driving the second liquid crystal panel 13 whose resolution is low. The refresh rate for driving the second liquid crystal panel 13 is preferably equal to an integral multiple of the refresh rate for driving the first liquid crystal panel 12; that is, for example, 360 Hz or 480 Hz.

Flowchart of Processing Executed by Signal Processor

Figure 3:
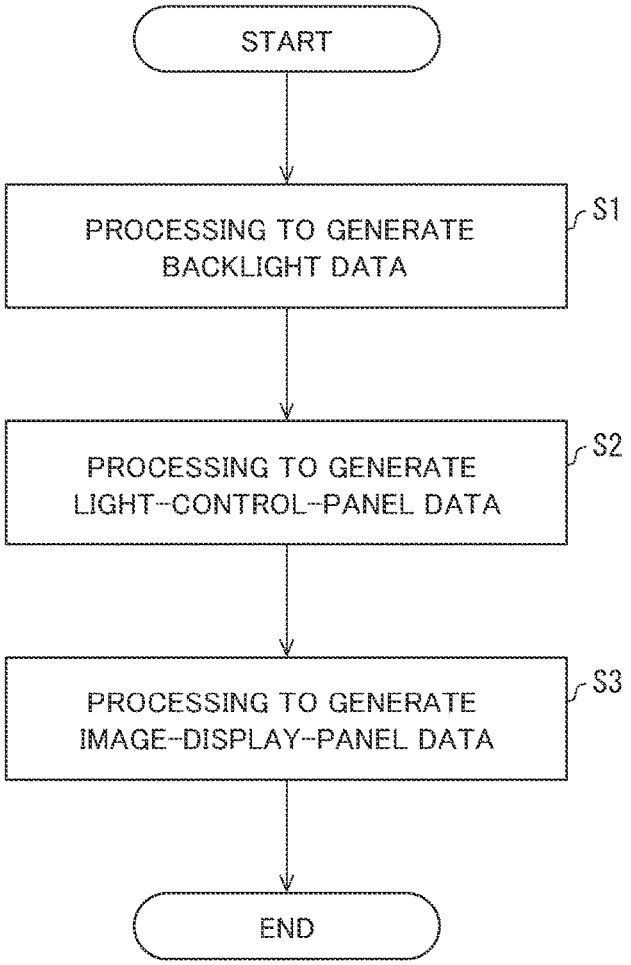
FIG. 3 is a flowchart of processing executed by a signal processor of the liquid crystal display device illustrated in FIG. 1.

FIG. 3 is a flowchart of processing executed by the signal processor 18 of the liquid crystal display device 1 illustrated in FIG. 1.

As shown in FIG. 3, at Step S1, the signal processor 18 executes processing to generate backlight data from input picture data. At Step S2, the signal processor 18 executes processing to generate light-control-panel data from the input picture data.

At Step S3, the signal processor 18 executes processing to generate image-display-panel data from the input picture data, the backlight data, and the light-control-panel data.

Note that FIG. 3 shows a case where the processing at Step S1 is followed by the processing at Step S2. In this embodiment, however, the order of the steps shall not be limited to such an order. The processing of Step S1 and the processing of Step S2 may be reversed or executed in parallel.

Timing Diagram

Figure 4:
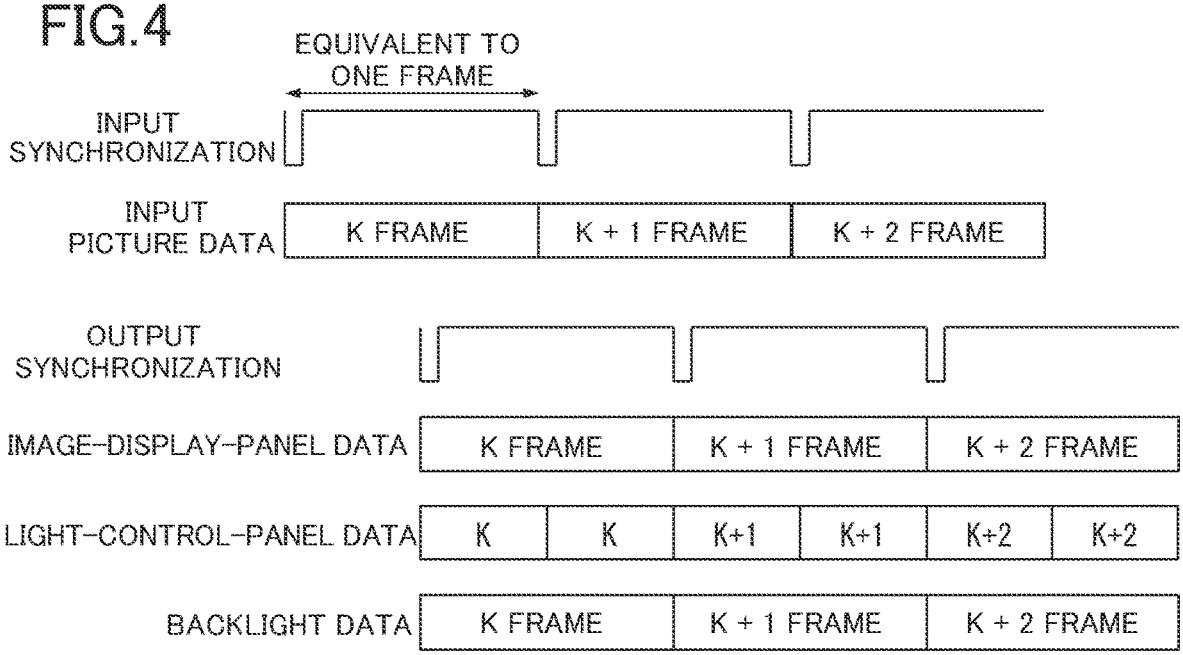
FIG. 4 is a timing diagram simplistically illustrating time points of various drive signals to be generated by the signal processor of the liquid crystal display device illustrated in FIG. 1.

FIG. 4 is a timing diagram simplistically illustrating time points of various drive signals to be generated by the signal processor 18 of the liquid crystal display device 1 illustrated in FIG. 1.

As illustrated in FIG. 4, the input picture data includes, for example, a K frame, a K+1 frame, and a K+2 frame. In such a case, the signal processor 18 generates as image-display-panel data a signal including the K frame, the K+1 frame, and the K+2 frame, and outputs the generated signal. Moreover, the signal processor 18 generates as backlight data a signal including the K frame, the K+1 frame, and the K+2 frame, and outputs the generated signal.

Figure 5:
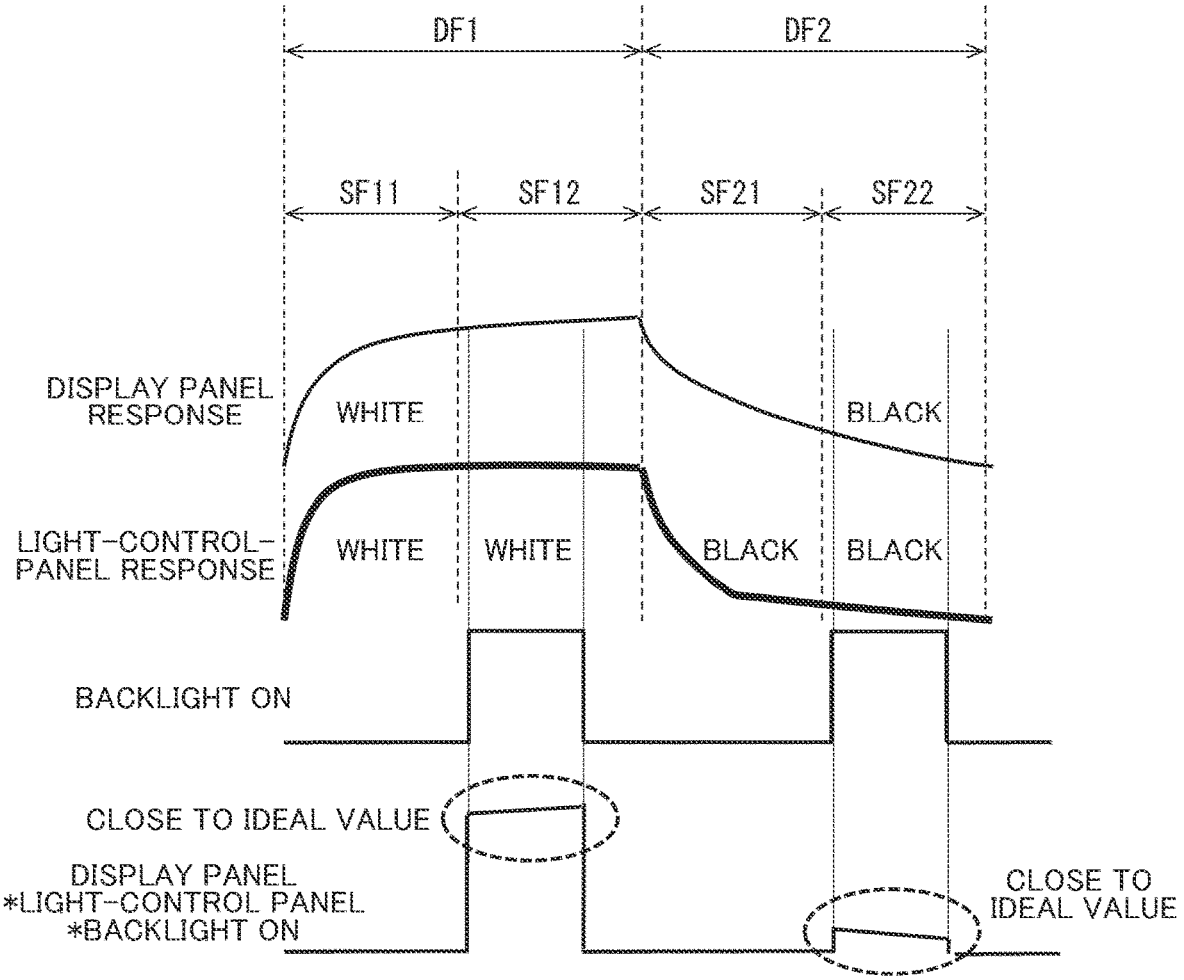
FIG. 5 is a timing diagram illustrating responsivities of a first liquid crystal panel and a second liquid crystal panel when the signal processor generates the various drive signals as seen in FIG. 4.

Meanwhile, as illustrated in FIG. 4, when the input picture data includes the K frame, the K+1 frame, and the K+2 frame, the signal processor 18 generates as light-control-panel data a signal including: two sub-frames into which a period of the K frame is divided; two sub-frames into which a period of the K+1 frame is divided; and two sub-frames into which a period of the K+2 frame is divided, and outputs the generated signal. As an example, the light-control-panel data may have the same value between the two sub-frames included in a frame. More specifically, the light-control-panel data may have the same signal value between two sub-frames K included in the K frame. FIG. 5 is a timing diagram illustrating responsivities of the image display panel 12 and the light-control panel 13 when the signal processor 18 generates the various drive signals as seen in FIG. 4.

As illustrated in FIG. 5, the image display panel 12 is driven at a frame rate including a DF1 and a DF2 as frame periods. Likewise, the backlight 11 is also driven at a frame rate including the DF1 and the DF2 as frame periods.

Meanwhile, the light-control panel 13 is driven at a frame rate including: two sub frame-periods SF11 and SF12 into which the frame period DF1 is divided; and two sub frame-periods SF21 and SF22 into which the frame period DF2 is divided. Hence, as an example in this embodiment, the light-control panel 13 is driven at a refresh rate twice as high as a fresh rate of the image display panel 12.

As can be seen, the light-control panel 13 is driven at a refresh rate higher than a refresh rate of the image display panel 12. Accordingly, during one frame period of the image display panel 12, the light-control panel 13 is driven multiple times, improving the responsivity of the light-control panel 13.

More specifically, as illustrated in FIG. 5, the light-control panel 13 is driven at the frame rates including the sub frame-periods SF11 and SF12 and the sub frame-periods SF21 and SF22. Hence, the light-control panel 13 can exhibit responsivity including quick power-up and power-down.

As a result, as illustrated in FIG. 5, an index; that is, the product of a responsivity of the image display panel 12, a responsibility of the light-control panel 13, and a responsibility of the turn-on of the backlight, is close to an ideal value (a theoretical value).

Second Embodiment

Described below is an other embodiment of the present invention. Note that, for the sake of description, like reference signs designate members having the same functions between the first and second embodiments. Such members will not be elaborated upon here. The second embodiment is different from the first embodiment in that the former includes a light-control-signal corrector 186.

Figure 6:
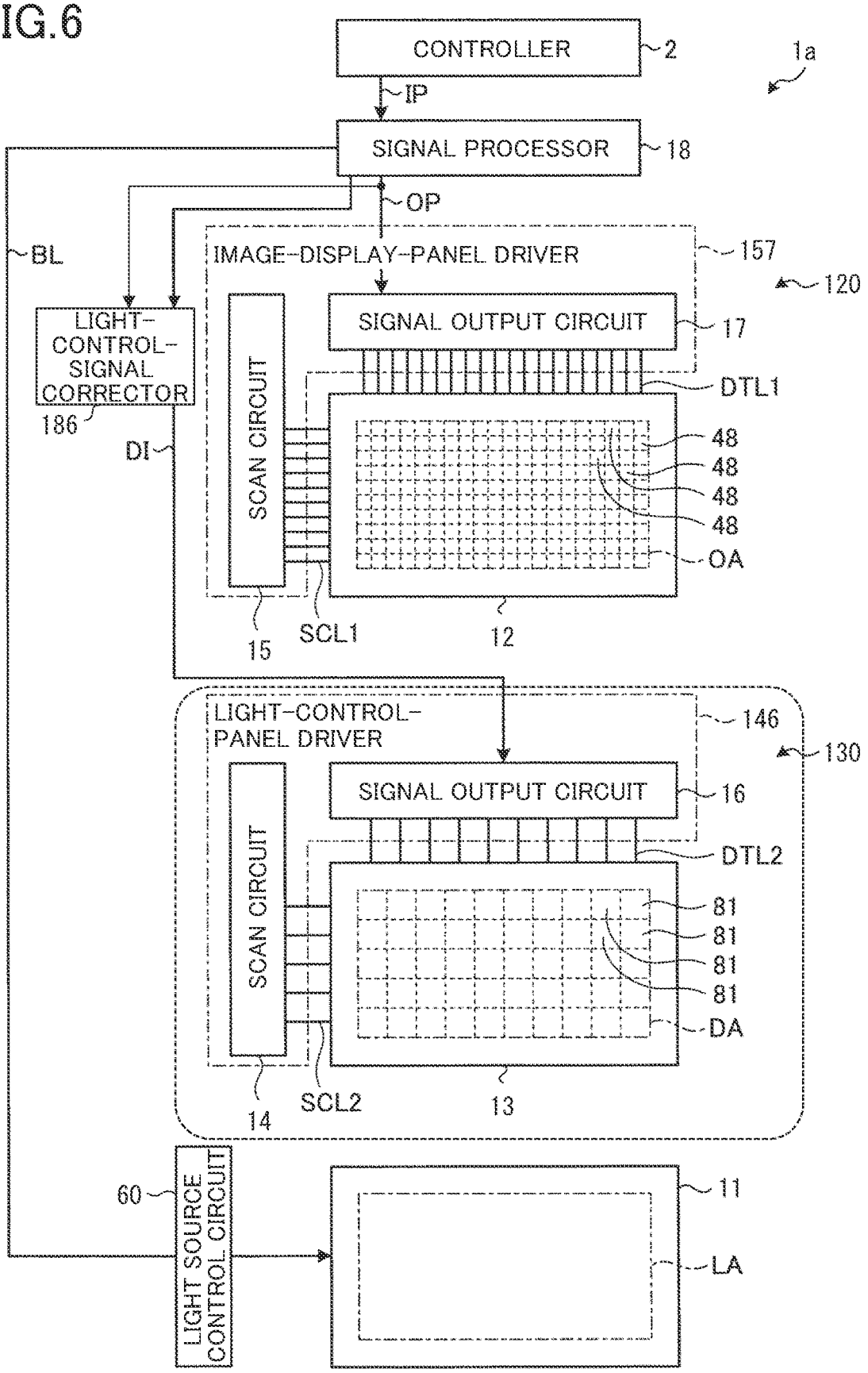
FIG. 6 is a diagram illustrating details of the features of a liquid crystal display device according to a second embodiment of the present invention.

The second embodiment is described below in detail, with reference to FIGS. 6 to 16. FIG. 6 is a diagram illustrating details of the features of a liquid crystal display device 1*a* according to this embodiment. As illustrated in FIG. 6, the liquid crystal display device 1*a* includes the light-control-signal corrector 186.

The light-control-signal corrector 186 receives from the signal processor 18 the image-display-panel data item OP to be output to the image display panel 12 and the light-control-panel data item DI to be output to the light-control panel 13, and corrects the light-control-panel data item DI to compensate for a response characteristic of the image display panel 12 (corresponding to Step S4 of FIG. 8 to be seen later).

Here, the light-control-signal corrector 186 determines pixel values of a plurality of pixels included in the light-control panel 13, with reference to pixel values of the pixels included in the image display panel 12 and corresponding to the pixels in the light-control panel 13.

In FIG. 6, the light-control-signal corrector 186 is provided separately from the signal processor 18. Alternatively, the light-control-signal corrector 186 may be disposed in any given position. For example, the light-control-signal corrector 186 may be disposed in the signal processor 18 or in the light-control-panel driver 146.

Timing Diagram

Figure 7:
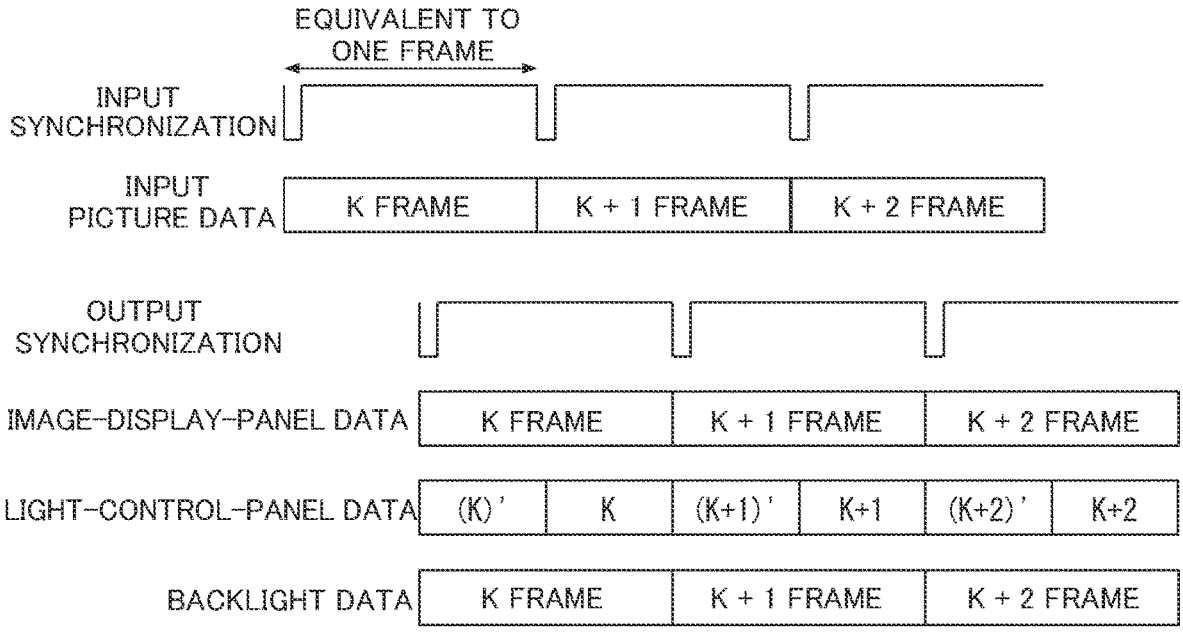
FIG. 7 is a timing diagram simplistically illustrating time points of various drive signals to be generated by the signal processor of the liquid crystal display device illustrated in FIG. 6.

FIG. 7 is a timing diagram simplistically illustrating time points of various drive signals to be generated by the signal processor 18 of the liquid crystal display device 1*a*.

As illustrated in FIG. 7, when the input picture data includes, for example, a K frame, a K+1 frame, and a K+2 frame, the signal processor 18 generates as image-display-panel data a signal including the K frame, the K+1 frame, and the K+2 frame, and outputs the generated signal. Moreover, the signal processor 18 generates as backlight data a signal including the K frame, the K+1 frame, and the K+2 frame, and outputs the generated signal.

Meanwhile, as illustrated in FIG. 7, when the input picture data includes the K frame, the K+1 frame, and the K+2 frame, the signal processor 18 generates as light-control-panel data a signal including: two sub-frames into which a period of the K frame is divided; two sub-frames into which a period of the K+1 frame is divided; and two sub-frames into which a period of the K+2 frame is divided, and outputs the generated signal. As an example, the light-control-panel data may have different values between the two sub-frames included in a frame. More specifically, the light-control-panel data may have different signal values between a sub-frame (K)' and a sub-frame K included in the frame K.

As illustrated in FIG. 7, the light-control-panel data has different signal values between the two sub-frames; namely, the sub-frame (K)' and the sub-frame K into which the K frame is divided. Likewise, the light-control-panel data has different signal values between two sub-frames; namely, a sub-frame (K+1)' and a sub-frame K+1 into which the K+1 frame is divided. Likewise, the light-control-panel data has different signal values between two sub-frames; namely, a sub-frame (K+2)' and a sub-frame K+2 into which the K+2 frame is divided.

Figure 8:
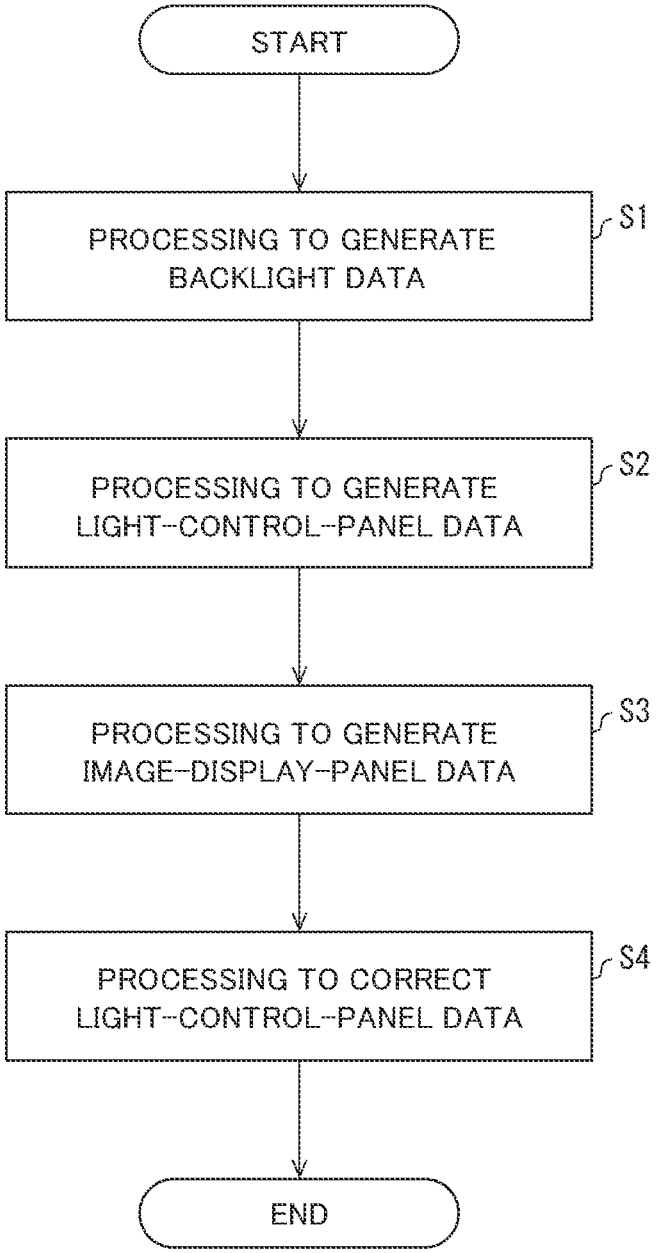
FIG. 8 is a flowchart of processing executed by the signal processor and a light-control-signal corrector of the liquid crystal display device illustrated in FIG. 6.

Flowchart of Processing Executed by Signal Processor and Light-Control-Signal Corrector FIG. 8 is a flowchart of processing executed by the signal processor 18 and the light-control-signal corrector 186 of the liquid crystal display device 1*a* illustrated in FIG. 6.

The processing at Steps S1 to S3 in FIG. 8 is the same as the processing at Steps S1 to S3 in FIG. 3, and the details of the processing will be omitted. At Step S4, the light-control-signal corrector 186 executes processing to correct the image-display-panel data in accordance with the light-control-panel data.

Flowchart of Processing Executed by Light-Control-Signal Corrector

Figure 9:
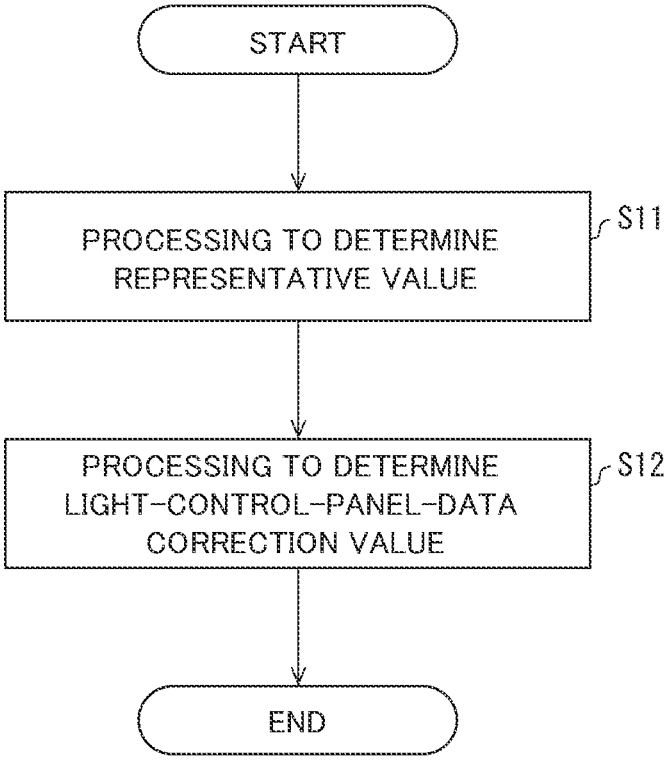
FIG. 9 is a flowchart of processing executed by the light-control-signal corrector of the liquid crystal display device illustrated in FIG. 6.

FIG. 9 is a flowchart of processing executed by the light-control-signal corrector 186 of the liquid crystal display device 1*a* illustrated in FIG. 6. More specifically, the flowchart in FIG. 9 shows details of the processing at Step S4 in FIG. 8.

As shown in FIG. 9, at Step S11, the light-control-signal corrector 186 executes processing to determine a representative value of the image-display-panel data for each of the regions, of the image display panel 12, corresponding to one of the divided regions 81 of the light-control panel 13. Next, at Step S12, the light-control-signal corrector 186 determines one of such four cases as drive examples 1 to 4 to be described below in this embodiment. For each of the divided regions 81 in the light-control panel 13, one of the four cases is determined from the light-control-panel data and the representative value of the image-display-panel data. In accordance with each of the cases, the light-control-signal corrector 186 executes processing to determine a light-control-panel-data correction value.

Described below in detail are specific drive examples of this embodiment, with reference to FIGS. 10 to 13.

Drive Example 1

Figure 10:
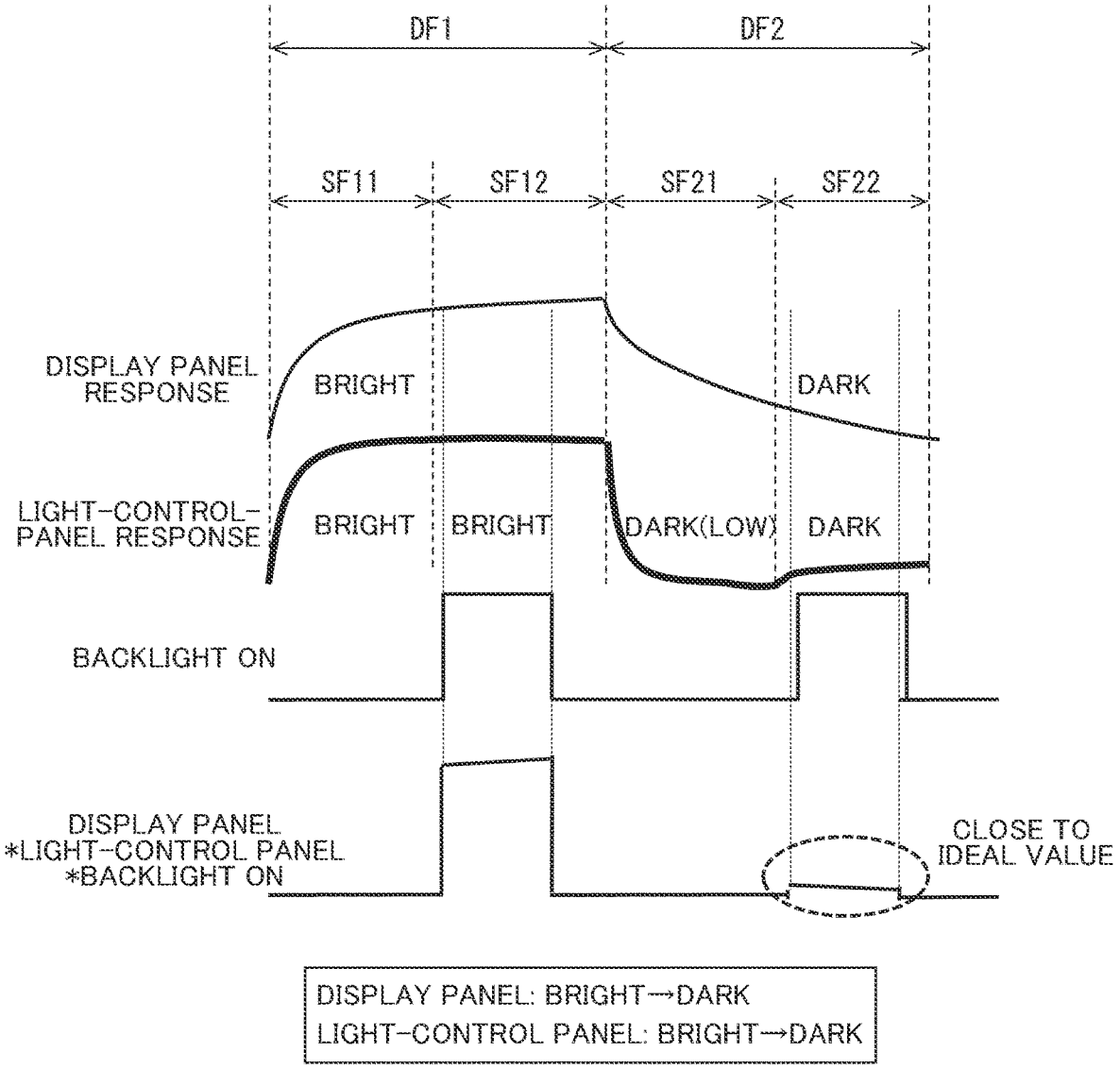
FIG. 10 is a diagram illustrating a drive example 1 by a driver of the liquid crystal display device illustrated in FIG. 6.

FIG. 10 is a diagram illustrating a drive example 1 by a driver; specifically, the light-control-signal corrector 186, of the liquid crystal display device 1*a* illustrated in FIG. 6.

FIG. 10 shows the drive example 1. When the light-control-signal corrector 186 (i) supplies a pixel, included in the image display panel 12, with a signal having a grayscale value lower in the second frame DF2 than in the first frame DF1, the second frame DF2 immediately succeeding the first frame DF1, and (ii) supplies an other pixel, included in the light-control panel 13 and corresponding to the pixel in the image display panel 12, with a signal having a grayscale value lower in the second frame DF2 than in the first frame DF1, the light-control-signal corrector 186 generates, for the other pixel included in the light-control panel 13 and corresponding to the pixel in the image display panel 12, a signal (i.e. corrected light-control-panel data) corrected to have a grayscale value lower in the first sub-frame SF21, included in the second frame DF2, than in the second sub-frame SF22 succeeding the first sub-frame SF21 (Step S4 in FIG. 8 and Step S12 in FIG. 9), and supplies the generated signal to the other pixel included in the light-control panel 13 and corresponding to the pixel in the image display panel 12.

Here, with reference to the light-control-panel data and the representative value of the image-display-panel data, the light-control-signal corrector 186 determines whether to supply the pixel, included in the image display panel 12, with the signal having the grayscale value lower in the second frame DF2 than in the first frame DF1 when the second frame DF2 immediately succeeds the first frame DF1, and to supply the other pixel, included in the light-control panel 13 and corresponding to the pixel in the image display panel 12, with the signal having the grayscale value lower in the second frame DF2 than in the first frame DF1. (See Examples 1 to 3 of Processing for Determining Representative Value and Processing for Light-Control-Panel-Data Correction to be specifically described later.)

Generally, it takes a certain time period until the image display panel 12 reaches a target dark state. In this drive example, the light-control panel 13 has two kinds of transmittance set for the first sub-frame (e.g. the sub-frame SF21) and the second sub-frame (e.g., the sub-frame SF22) included in a frame (e.g. the frame DF2). In this drive example, the light-control panel 13 is controlled in the first sub-frame SF21 to be darker than the light-control-panel data before correction indicates, and is driven in the second sub-frame SF22 in the dark state as indicated by the light-control-panel data before correction.

The driver 10 drives the light-control panel 13 as described above, and allows the liquid crystal display device 1*a* to achieve more beneficially a display condition close to an ideal value (a theoretical value).

Drive Example 2

Figure 11:
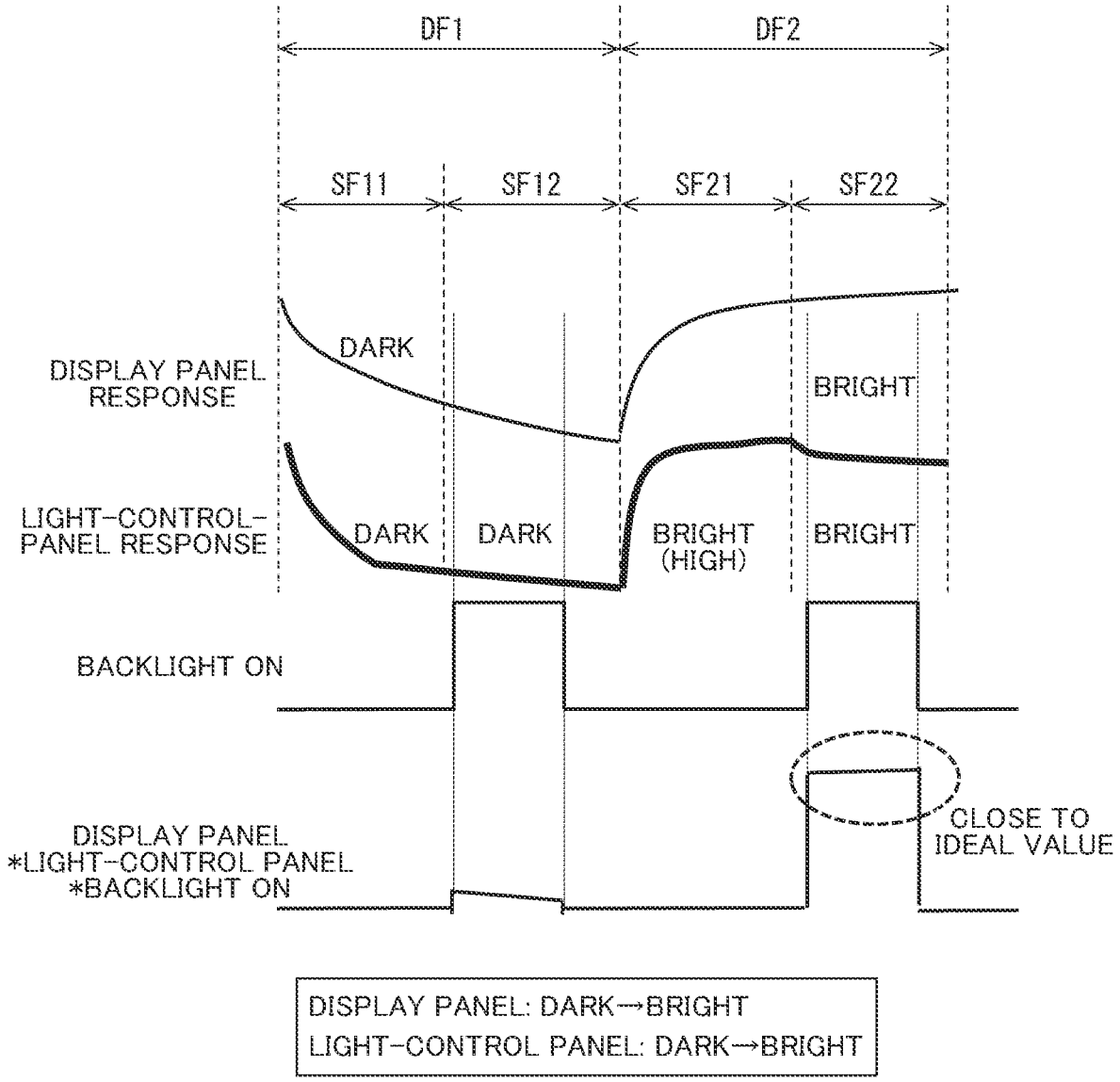
FIG. 11 is a diagram illustrating a drive example 2 by the driver of the liquid crystal display device illustrated in FIG. 6.

FIG. 11 is a diagram illustrating a drive example 2 by the driver; specifically, the light-control-signal corrector 186, of the liquid crystal display device 1*a* illustrated in FIG. 6.

FIG. 11 shows the drive example 2. When the light-control-signal corrector 186 (i) supplies a pixel, included in the image display panel 12, with a signal having a grayscale value higher in the second frame DF2 than in the first frame DF1, the second frame DF2 immediately succeeding the first frame DF1, and (ii) supplies an other pixel, included in the light-control panel 13 and corresponding to the pixel in the image display panel 12, with a signal having a grayscale value higher in the second frame DF2 than in the first frame DF1, the light-control-signal corrector 186 generates, for the other pixel included in the light-control panel 13 and corresponding to the pixel in the image display panel 12, a signal (i.e. corrected light-control-panel data) corrected to have a grayscale value higher in the first sub-frame SF21, included in the second frame DF2, than in the second sub-frame SF22 succeeding the first sub-frame SF21 (Step S4 in FIG. 8 and Step S12 in FIG. 9), and supplies the generated signal to the other pixel included in the light-control panel 13 and corresponding to the pixel in the image display panel 12.

Here, with reference to the light-control-panel data and the representative value of the image-display-panel data, the light-control-signal corrector 186 determines whether to supply the pixel, included in the image display panel 12, with the signal having the grayscale value higher in the second frame DF2 than in the first frame DF1 when the second frame DF2 immediately succeeds the first frame DF1, and to supply the other pixel, included in the light-control panel 13 and corresponding to the pixel in the image display panel 12, with the signal having the grayscale value higher in the second frame DF2 than in the first frame DF1. (See Examples 1 to 3 of Processing for Determining Representative Value and Processing for Light-Control-Panel-Data Correction to be specifically described later.)

In this drive example, the light-control panel 13 is controlled in the first sub-frame SF21 to be brighter than the light-control-panel data before correction indicates, and is driven in the second sub-frame SF22 in the bright state as indicated by the light-control-panel data before correction.

The driver 10 drives the light-control panel 13 as described above, and allows the liquid crystal display device 1*a* to achieve more beneficially a display condition close to an ideal value (a theoretical value).

Drive Example 3

Figure 12:
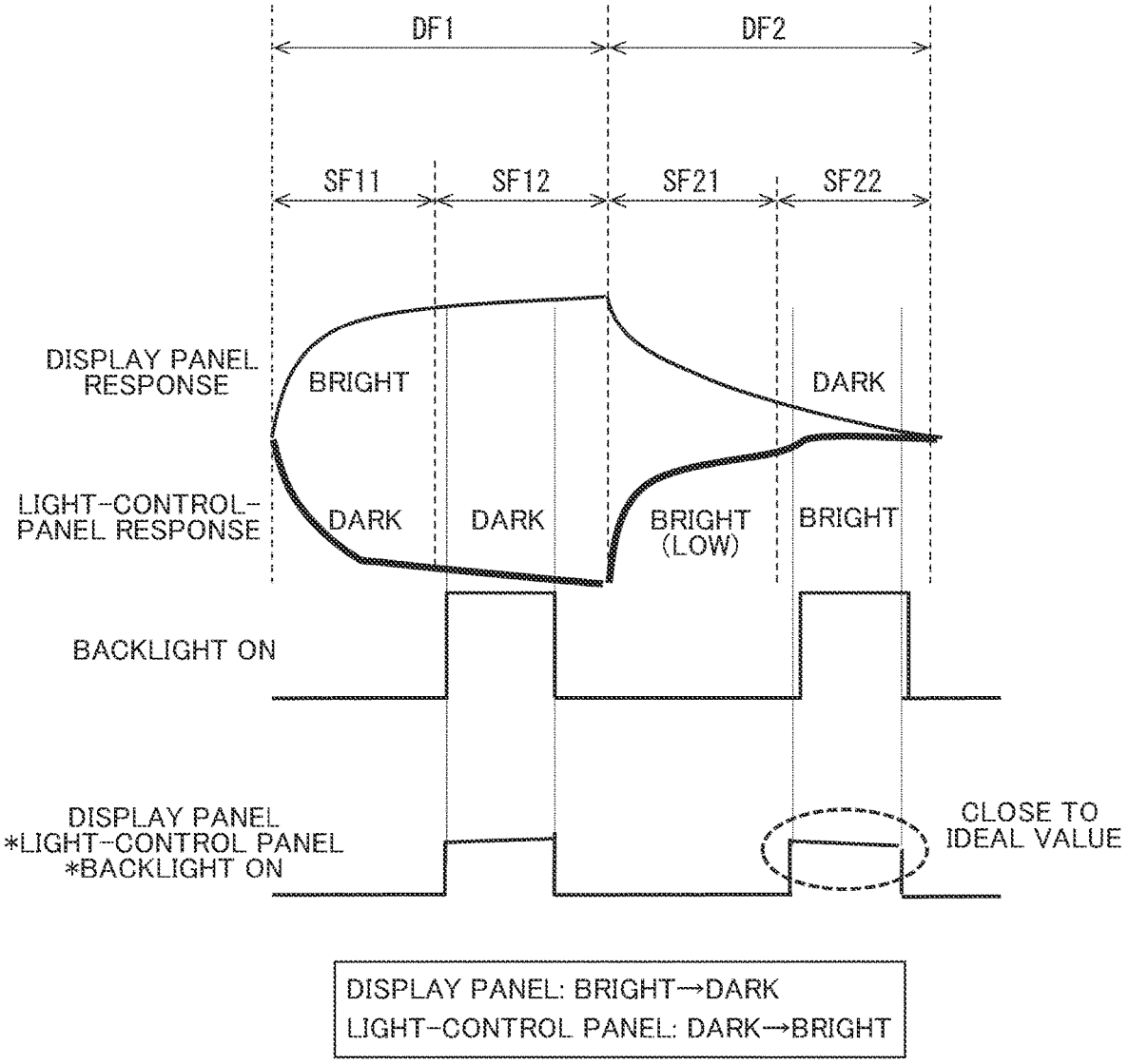
FIG. 12 is a diagram illustrating a drive example 3 by the driver of the liquid crystal display device illustrated in FIG. 6.

FIG. 12 is a diagram illustrating a drive example 3 by the driver; specifically, the light-control-signal corrector 186, of the liquid crystal display device 1 a illustrated in FIG. 6.

FIG. 12 shows the drive example 3. When the light-control-signal corrector 186 (i) supplies a pixel, included in the image display panel 12, with a signal having a grayscale value lower in the second frame DF2 than in the first frame DF1, the second frame DF2 immediately succeeding the first frame DF1, and (ii) supplies an other pixel, included in the light-control panel 13 and corresponding to the pixel in the image display panel 12, with a signal having a grayscale value higher in the second frame DF2 than in the first frame DF1, the light-control-signal corrector 186 generates, for the other pixel included in the light-control panel 13 and corresponding to the pixel in the image display panel 12, a signal (i.e. corrected light-control-panel data) corrected to have a grayscale value lower in the first sub-frame SF21, included in the second frame DF2, than in the second sub-frame SF22 succeeding the first sub-frame SF21 (Step S4 in FIG. 8 and Step S12 in FIG. 9), and supplies the generated signal to the other pixel included in the light-control panel 13 and corresponding to the pixel in the image display panel 12.

Here, with reference to the light-control-panel data and the representative value of the image-display-panel data, the light-control-signal corrector 186 determines whether to supply the pixel, included in the image display panel 12, with the signal having the grayscale value lower in the second frame DF2 than in the first frame DF1 when the second frame DF2 immediately succeeds the first frame DF1, and to supply the other pixel, included in the light-control panel 13 and corresponding to the pixel in the image display panel 12, with the signal having the grayscale value higher in the second frame DF2 than in the first frame DF1. (See Examples 1 to 3 of Processing for Determining Representative Value and Processing for Light-Control-Panel-Data Correction to be specifically described later.)

In this drive example, the light-control panel 13 is controlled in the first sub-frame SF21 to be darker than the light-control-panel data before correction indicates, and is driven in the second sub-frame SF22 in the bright state as indicated by the light-control-panel data before correction.

The driver 10 drives the light-control panel 13 as described above, and allows the liquid crystal display device 1*a* to achieve more beneficially a display condition close to an ideal value (a theoretical value).

Drive Example 4

Figure 13:
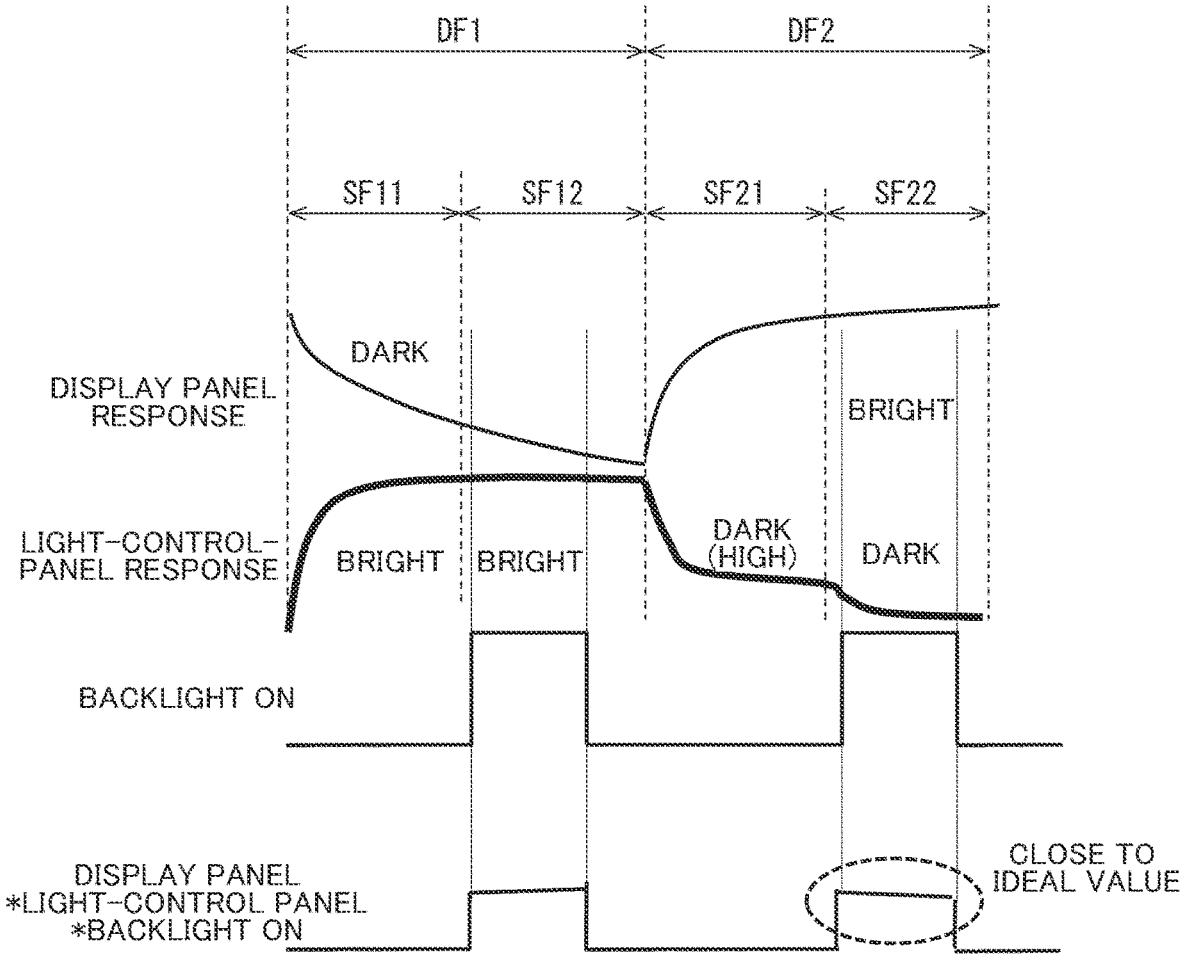
FIG. 13 is a diagram illustrating a drive example 4 by the driver of the liquid crystal display device illustrated in FIG. 6.

FIG. 13 is a diagram illustrating a drive example 4 by the driver; specifically, the light-control-signal corrector 186, of the liquid crystal display device 1*a* illustrated in FIG. 6.

FIG. 13 shows the drive example 4. When the light-control-signal corrector 186 (i) supplies a pixel, included in the image display panel 12, with a signal having a grayscale value higher in the second frame DF2 than in the first frame DF1, the second frame DF2 immediately succeeding the first frame DF1, and (ii) supplies an other pixel, included in the light-control panel 13 and corresponding to the pixel in the image display panel 12, with a signal having a grayscale value lower in the second frame DF2 than in the first frame DF1, the light-control-signal corrector 186 generates, for the other pixel included in the light-control panel 13 and corresponding to the pixel in the image display panel 12, a signal (i.e. corrected light-control-panel data) corrected to have a grayscale value higher in the first sub-frame SF21, included in the second frame DF2, than in the second sub-frame SF22 succeeding the first sub-frame SF21 (Step S4 in FIG. 8 and Step S12 in FIG. 9), and supplies the generated signal to the other pixel included in the light-control panel 13 and corresponding to the pixel in the image display panel 12.

Here, with reference to the light-control-panel data and the representative value of the image-display-panel data, the light-control-signal corrector 186 determines whether to supply the pixel, included in the image display panel 12, with the signal having the grayscale value higher in the second frame DF2 than in the first frame DF1 when the second frame DF2 immediately succeeds the first frame DF1, and to supply the other pixel, included in the light-control panel 13 and corresponding to the pixel in the image display panel 12, with the signal having the grayscale value lower in the second frame DF2 than in the first frame DF1. (See Examples 1 to 3 of Processing for Determining Representative Value and Processing for Light-Control-Panel-Data Correction to be specifically described later.)

In this drive example, the light-control panel 13 is controlled in the first sub-frame SF21 to be brighter than the light-control-panel data before correction indicates, and is driven in the second sub-frame SF22 in the dark state as indicated by the light-control-panel data before correction.

The driver 10 drives the light-control panel 13 as described above, and allows the liquid crystal display device 1*a* to achieve more beneficially a display condition close to an ideal value (a theoretical value).

Processing for Determining Representative Value and Processing for Determining Light-Control-Panel-Data Correction Value Described below are processing for determining a representative value and processing for determining a light-control-panel-data correction value at Step S4 in FIG. 8 and at Steps S11 and S12 in FIG. 9, with reference to drawings.

As described above, at Step S4 in FIG. 8, the light-control-signal corrector 186 according to this embodiment corrects the image-display-panel data and the light-control-panel data to generate the light-control-panel data.

In this embodiment, the light-control panel 13 is lower in resolution than the image display panel 12, and one divided region 81 of the light-control panel 13 corresponds to two or more pixels of the image display panel 12.

Hence, two or more of image-display-panel data items are to be referred to when the signal processor 18 and the light-control-signal corrector 186 generate and correct the light-control-panel data for a divided region 81 in the light-control panel 13.

Hence, in this embodiment, the light-control-signal corrector 186 (i) determines a representative value of the image-display-panel data for each of the regions, of the image display panel 12, corresponding to one of the divided regions 81 of the light-control panel 13, (ii) determines, for each of the divided regions 81 of the light-control panel 13, one of the above four cases of the drive examples 1 to 4 from the light-control-panel data and the representative value of the light-control-panel data, and (iii) determines a light-control-panel data correction value in accordance with each of the cases.

Described below are examples of how the light-control-signal corrector 186 executes processing for determining a representative value of the image-display-panel data and processing for correcting the light-control-panel data.

Figure 14:
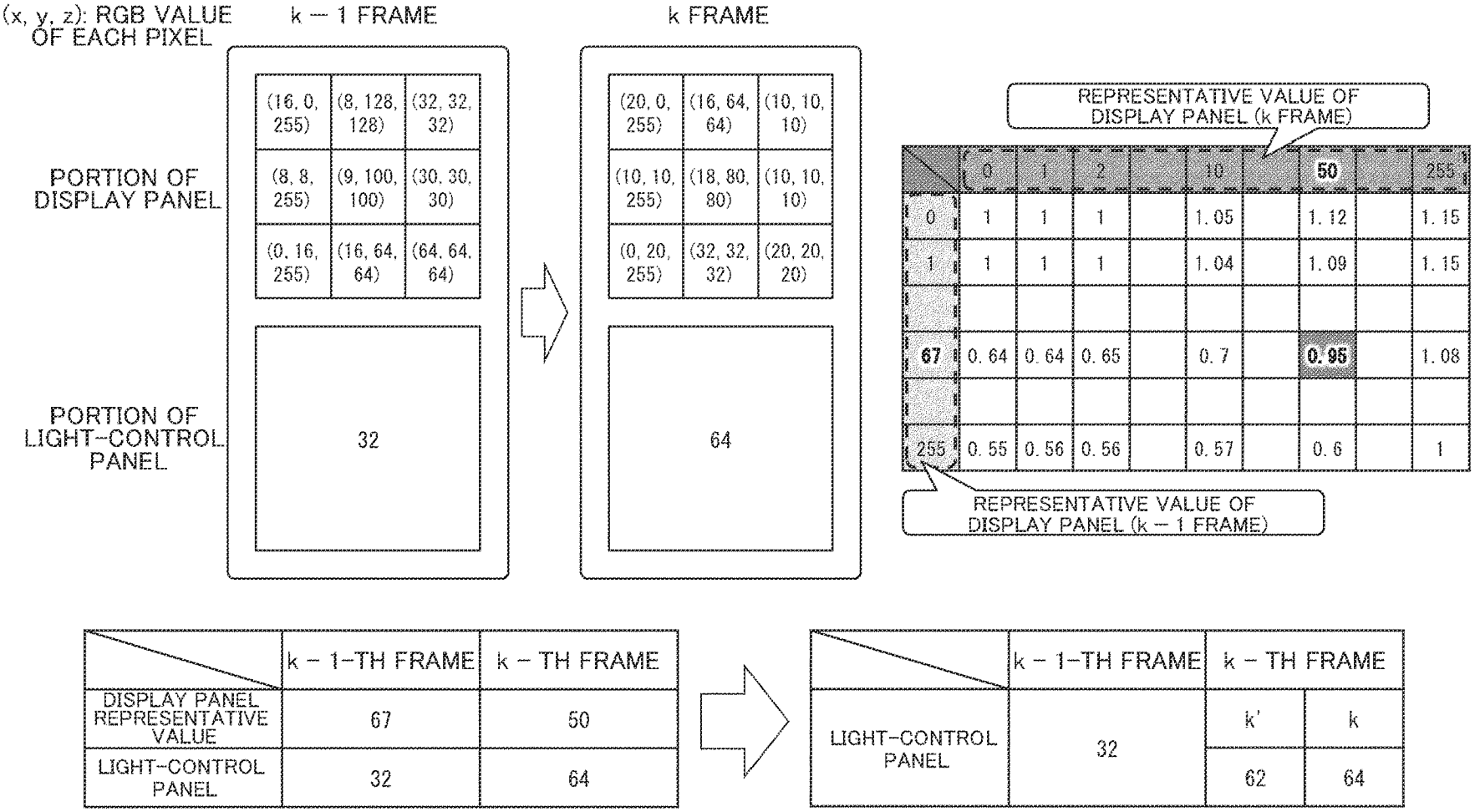
FIG. 14 is a schematic diagram illustrating an example 1 of processing for determining a representative value and processing for correcting light-control-panel data.

Example 1 of Processing for Determining Representative Value and Processing for Correcting Light-Control-Panel Data FIG. 14 is a schematic diagram illustrating an example 1 of processing for determining a representative value and processing for correcting light-control-panel data. In the example illustrated in FIG. 14, pixels of 3×3=9 included in the image display panel 12 correspond to one divided region included in the light-control panel 13.

In this example, the light-control-signal corrector 186 calculates an average of the pixel values of the nine pixels in the display panel 12, and determines a representative value, of the image-display-panel data, for a region included in the image display panel 12 and corresponding to the divided region 81.

More specifically, in the example illustrated in FIG. 14, the light-control-signal corrector 186 calculates for a k−1 frame an average of the pixel values of 27 sub-pixels RGB in total included in nine pixels as (16+0+255+ . . . +64)/27=67, and determines 67 as the representative value of the image-display-panel data in the k−1 frame.

The example illustrated in FIG. 14 shows that, in the corresponding divided region of the light-control panel, the light-control-panel data in the k−1 frame has a pixel value of 32.

Furthermore, the light-control-signal corrector 186 calculates for a k frame an average of the pixel values of 27 sub-pixels RGB in total included in the nine pixels as (20+0+255+. . . +20)/27=50, and determines 50 as the representative value of the image-display-panel data in the k frame.

The example illustrated in FIG. 14 shows that, in the corresponding divided region of the light-control panel, the light-control-panel data in the k frame has a pixel value of 64.

As can be seen, the example illustrated in FIG. 14 shows that, from the k−1 frame to the k frame, the representative value of the image-display-panel data changes from 67 to 50, and the pixel value of the light-control-panel data changes from 32 to 64. That is, the example illustrated in FIG. 14 shows that, from the k−1 frame to the k frame, the image display panel 12 changes from the bright state to the dark state, and the light-control panel 13 changes from the dark state to the bright state. Accordingly, the light-control-signal corrector 186 determines that the example illustrated in FIG. 14 meets the drive example 3 illustrated in FIG. 12.

In this situation, with reference to a table (a correction coefficient table) illustrated in the top-right of FIG. 14, the light-control-signal corrector 186 determines a correction coefficient to be used for correcting the light-control-panel data. Note that the table in the top-right of FIG. 14 is used for the drive example 3 in FIG. 12. Although not described in this specification, the light-control-signal corrector 186 includes, other than the above table, tables to be used for the cases of the drive example 1 in FIG. 10, the drive example 2 in FIG. 11, and the drive example 4 in FIG. 13. The same goes for a processing example 2 described below.

More specifically, with reference to the correction coefficient table, the light-control-signal corrector 186 determines a correction coefficient of 0.95 when the representative value of the k−1-th frame is 67 and the representative value of the k-th frame is 50. After that, with reference to the determined correction coefficient, the light-control-panel data in the k-th frame, and the light-control-panel data in the k−1-th frame, the light-control-signal corrector 186 derives corrected light-control-panel data in the k-th frame.

As an example, the light-control-signal corrector 186 calculates (64−32)×0.95+32=62.4, and drives 62.4 as a value of the corrected light-control-panel data in the k-th frame. Moreover, the light-control-signal corrector 186 converts the value of the corrected light-control-panel data into an integer of 62.

Hence, the light-control-signal corrector 186 determines a representative value of the image-display-panel data for each of the regions, of the image display panel 12, corresponding to one of the divided regions 81 of the light-control panel 13, and determines one of the above four cases of the drive examples 1 to 4 from the light-control-panel data and the representative value of the light-control-panel data. After that, with reference to the light-control-panel data and the representative value of the image-display-panel data, the light-control-signal corrector 186 determines the light-control-panel-data correction value for each of the divided regions 81 of the light-control panel 13 in accordance with each of the cases. Thanks to such features, the liquid crystal display device 1*a* according to the second embodiment can beneficially execute the processing for correcting the light-control-panel data.

Figure 15:
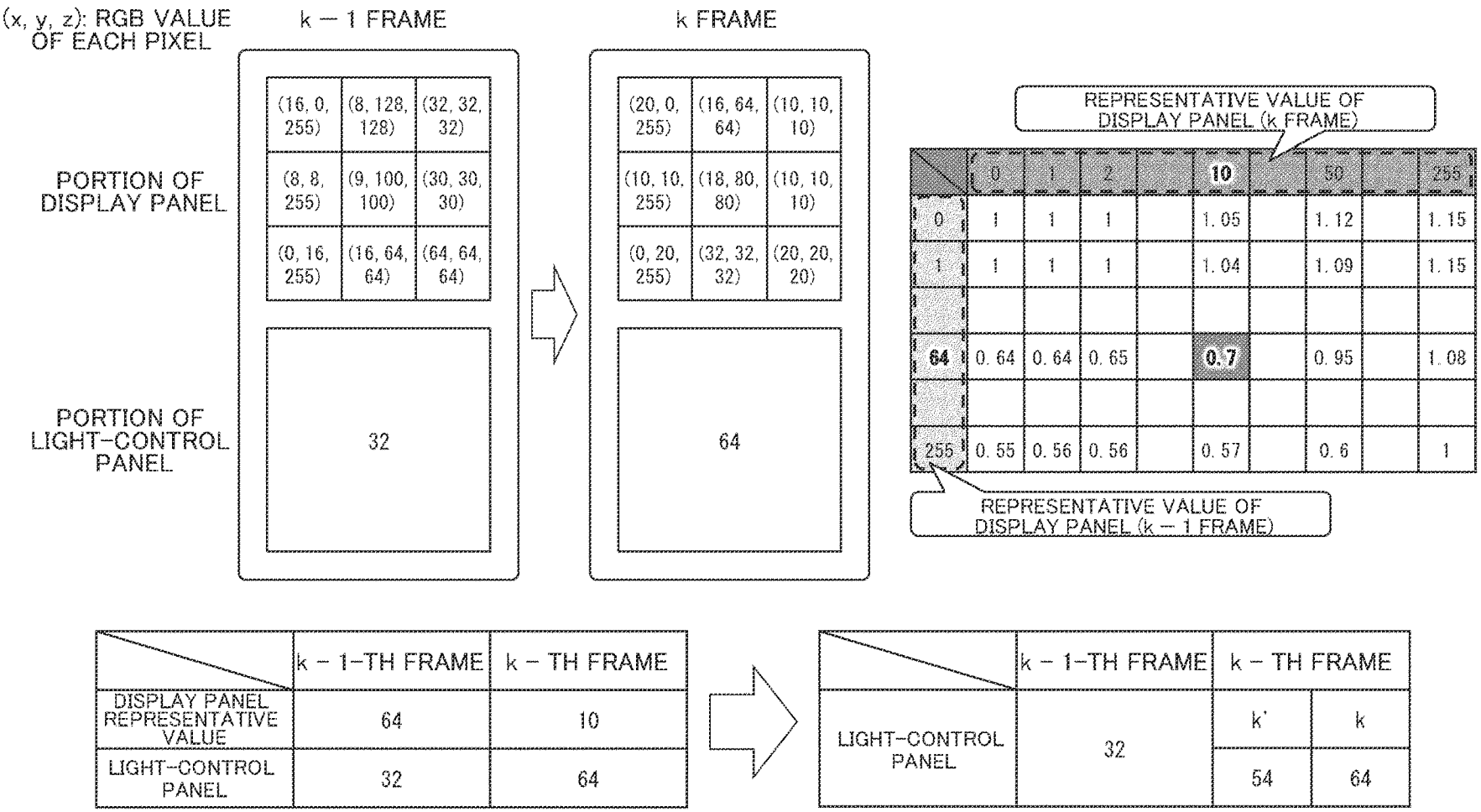
FIG. 15 is a schematic diagram illustrating an example 2 of processing for determining a representative value and processing for correcting light-control-panel data.

Example 2 of Processing for Determining Representative Value and Processing for Light-Control-Panel-Data Correction FIG. 15 is a schematic diagram illustrating an example 2 of processing for determining a representative value and processing for correcting light-control-panel data. In the example illustrated in FIG. 15, as seen in FIG. 14, pixels of 3×3=9 included in the image display panel 12 correspond to one divided region included in the light-control panel 13.

In this example, the light-control-signal corrector 186 obtains a most frequent value of the pixel values of the nine pixels in the display panel 12, and determines a representative value, of the image-display-panel data, for a region included in the image display panel 12 and corresponding to the divided region 81.

More specifically, in the example illustrated in FIG. 15, the light-control-signal corrector 186 obtains the most frequent value of the pixel values of the nine pixels, and determines 64 as the representative value of the image-display-panel data in the k−1 frame.

The example illustrated in FIG. 15 shows that, in the corresponding divided region of the light-control panel, the light-control-panel data in the k−1 frame has a pixel value of 32.

Furthermore, the light-control-signal corrector 186 obtains for the k frame a most frequent value of the pixel values of the nine pixels, and determines 10 as the representative value of the image-display-panel data in the k frame.

The example illustrated in FIG. 15 shows that, in the corresponding divided region of the light-control panel, the light-control-panel data in the k frame has a pixel value of 64.

As can be seen, the example illustrated in FIG. 15 shows that, from the k−1 frame to the k frame, the representative value of the image-display-panel data changes from 64 to 10, and the pixel value of the light-control-panel data changes from 32 to 64. That is, the example illustrated in FIG. 15 shows that, from the k−1 frame to the k frame, the image display panel 12 changes from the bright state to the dark state, and the light-control panel 13 changes from the dark state to the bright state. Accordingly, the light-control-signal corrector 186 determines that the example illustrated in FIG. 15 meets the drive example 3 illustrated in FIG. 12.

In this situation, with reference to a table (a correction coefficient table) illustrated in the top-right of FIG. 15, the light-control-signal corrector 186 determines a correction coefficient to be used for correcting the light-control-panel data. Note that the table in the top-right of FIG. 15 is used for the drive example 3 in FIG. 12, and is the same as the table in the top-right of FIG. 14.

More specifically, with reference to the correction coefficient table, the light-control-signal corrector 186 determines 0.75 as a correction coefficient when the representative value of the k−1-th frame is 64 and the representative value of the k-th frame is 10. After that, with reference to the determined correction coefficient, the light-control-panel data in the k-th frame, and the light-control-panel data in the k−1-th frame, the light-control-signal corrector 186 derives corrected light-control-panel data in the k-th frame.

As an example, the light-control-signal corrector 186 calculates (64−32)×0.7+32=54.4, and drives 54.4 as a value of the corrected light-control-panel data in the k-th frame. Moreover, the light-control-signal corrector 186 converts the value of the corrected light-control-panel data into an integer of 54.

Hence, the light-control-signal corrector 186 determines a representative value of the image-display-panel data for each of the regions, of the image display panel 12, corresponding to one of the divided regions 81 of the light-control panel 13, and determines one of the above four cases of the drive examples 1 to 4 from the light-control-panel data and the representative value of the light-control-panel data. After that, with reference to the light-control-panel data and the representative value of the image-display-panel data, the light-control-signal corrector 186 determines the light-control-panel-data correction value for each of the divided regions 81 of the light-control panel 13 in accordance with each of the cases. Thanks to such features, the liquid crystal display device 1*a* according to the second embodiment can beneficially execute the processing for correcting the light-control-panel data.

Figure 16:
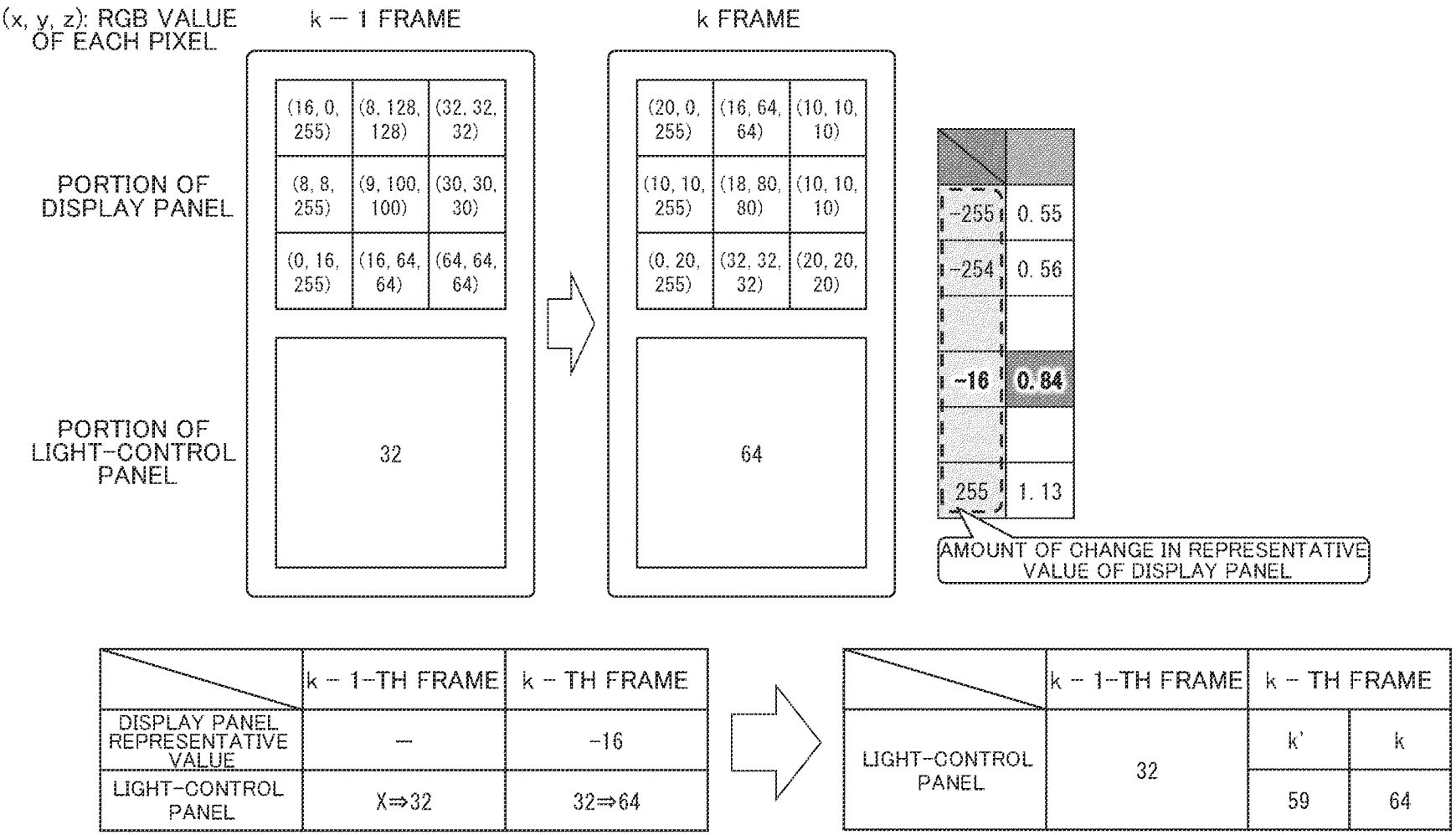
FIG. 16 is a schematic diagram illustrating an example 3 of processing for determining a representative value and processing for correcting light-control-panel data.

Example 3 of Processing for Determining Representative Value and Processing for Light-Control-Panel-Data Correction FIG. 16 is a schematic diagram illustrating an example 3 of processing for determining a representative value and processing for correcting light-control-panel data. In the example illustrated in FIG. 16, as seen in FIG. 14, pixels of 3×3=9 included in the image display panel 12 correspond to one divided region included in the light-control panel 13.

In this example, the light-control-signal corrector 186 calculates an average value of changes in the pixel values of the nine pixels in the display panel 12, and determines a change, in a representative value of the image-display-panel data, for a region included in the image display panel 12 and corresponding to the divided region 81.

As more specifically seen in an example of FIG. 16, from the k−1 frame to the k frame, the light-control-signal corrector 186 calculates an average of changes in the pixel values of 27 sub-pixels RGB in total included in the nine pixels as {(20−16)+(0−0)+(255−255)+(16−8)+(64−128)+ . . . +(20−64)/27=−16.48. After that, the control signal corrector 186 converts the average into an integer to determine −16 as the change in the representative value of the image-display-panel data from the k−1 frame to the k frame.

The example illustrated in FIG. 16 shows that, in the corresponding divided region of the light-control panel, the light-control-panel data has a pixel value of 32 in the k−1 frame and a pixel value of 64 in the k frame.

As can be seen, the example illustrated in FIG. 16 shows that, from the k−1 frame to the k frame, the change in the representative value of the image-display-panel data is 16, and the pixel value of the light-control-panel data changes from 32 to 64. That is, the example illustrated in FIG. 16 shows that, from the k−1 frame to the k frame, the image display panel 12 changes from the bright state to the dark state, and the light-control panel 13 changes from the dark state to the bright state. Accordingly, the light-control-signal corrector 186 determines that the example illustrated in FIG. 16 meets the drive example 3 illustrated in FIG. 12.

In this situation, with reference to a table (a correction coefficient table) illustrated in the top-right of FIG. 16, the light-control-signal corrector 186 determines a correction coefficient to be used for correcting the light-control-panel data. Note that the table in the top-right of FIG. 16 is used for the drive example 3 in FIG. 12. Although not described in this specification, the light-control-signal corrector 186 includes, other than the above table, tables to be used for the cases of the drive example 1 in FIG. 10, the drive example 2 in FIG. 11, and the drive example 4 in FIG. 13.

More specifically, with reference to the correction coefficient table, the light-control-signal corrector 186 determines 0.84 as a correction coefficient when the change in the representative value of the image-display-panel data is 16 from the k−1 frame to k frame. After that, with reference to the determined correction coefficient, the light-control-panel data in the k frame, and the light-control-panel data in the k−1 frame, the light-control-signal corrector 186 derives corrected light-control-panel data in the k-th frame.

As an example, the light-control-signal corrector 186 calculates (64−32)×0.84+32=58.88, and drives 58.88 as a value of the corrected light-control-panel data in the k-th frame. Moreover, the light-control-signal corrector 186 converts the value of the corrected light-control-panel data into an integer of 59.

Hence, the light-control-signal corrector 186 determines a representative value of the image-display-panel data for each of the regions, of the image display panel 12, corresponding to one of the divided regions 81 of the light-control panel 13, and determines one of the above four cases of the drive examples 1 to 4 from the light-control-panel data and the representative value of the light-control-panel data. After that, with reference to the light-control-panel data and the representative value of the image-display-panel data, the light-control-signal corrector 186 determines the light-control-panel-data correction value for each of the divided regions 81 of the light-control panel 13 in accordance with each of the cases. Thanks to such features, the liquid crystal display device 1 a according to the second embodiment can beneficially execute the processing for correcting the light-control-panel data.

Moreover, as described in the drive examples 1 to 4, and the examples 1 to 3 of processing for determining a representative value and processing for correcting light-control-panel data, the light-control-signal corrector 186 corrects the light-control-panel data to compensate for a response characteristic of the image display panel 12.

Third Embodiment

Described below is still an other embodiment of the present invention. Note that, for the sake of description, like reference signs designate members having the same functions between this embodiment and the above embodiments. Such members will not be elaborated upon here. The third embodiment is different from the first and second embodiments in that the former includes a display-panel-signal corrector 187.

Figure 17:
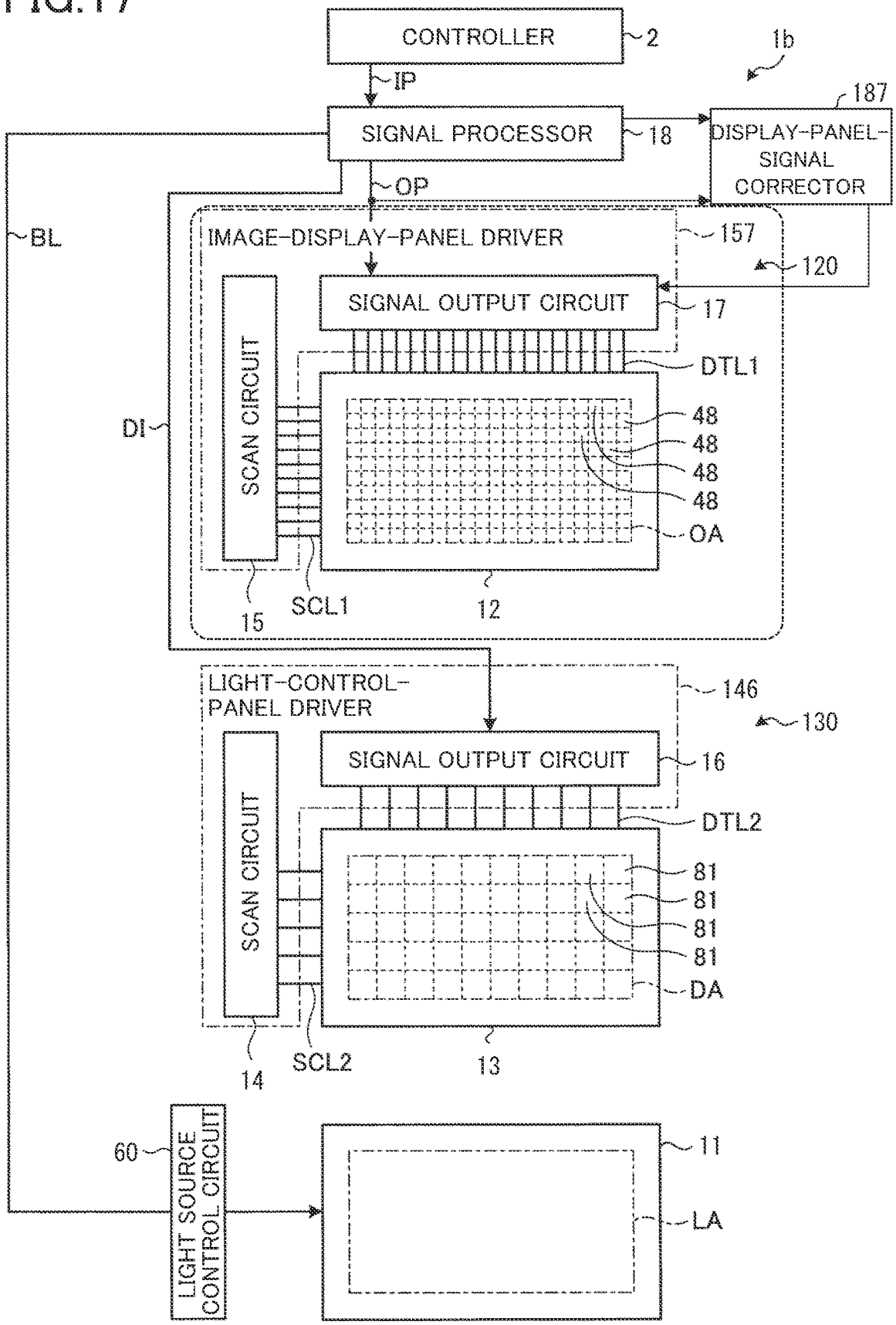
FIG. 17 is a diagram illustrating details of the features of a liquid crystal display device according to a third embodiment of the present invention.

The third embodiment is described below in detail, with reference to FIGS. 17 to 25. FIG. 17 is a diagram illustrating details of the features of a liquid crystal display device 1*b* according to this embodiment. As illustrated in FIG. 17, the liquid crystal display device 1*b* includes the display-panel-signal corrector 187.

The display-panel-signal corrector 187 receives from the signal processor 18 the image-display-panel data item OP to be output to the image display panel 12 and the light-control-panel data item DI to be output to the light-control panel 13, and corrects the image-display-panel data item OP to compensate for a response characteristic of the light-control panel 13 (corresponding to Step S5 of FIG. 19 to be seen later).

In FIG. 17, the display-panel-signal corrector 187 is provided separately from the signal processor 18. Alternatively, the display-panel-signal corrector 187 may be disposed in any given position. For example, the display-panel-signal corrector 187 may be disposed in the signal processor 18 or in the image-display-panel driver 157.

Timing Diagram

Figure 18:
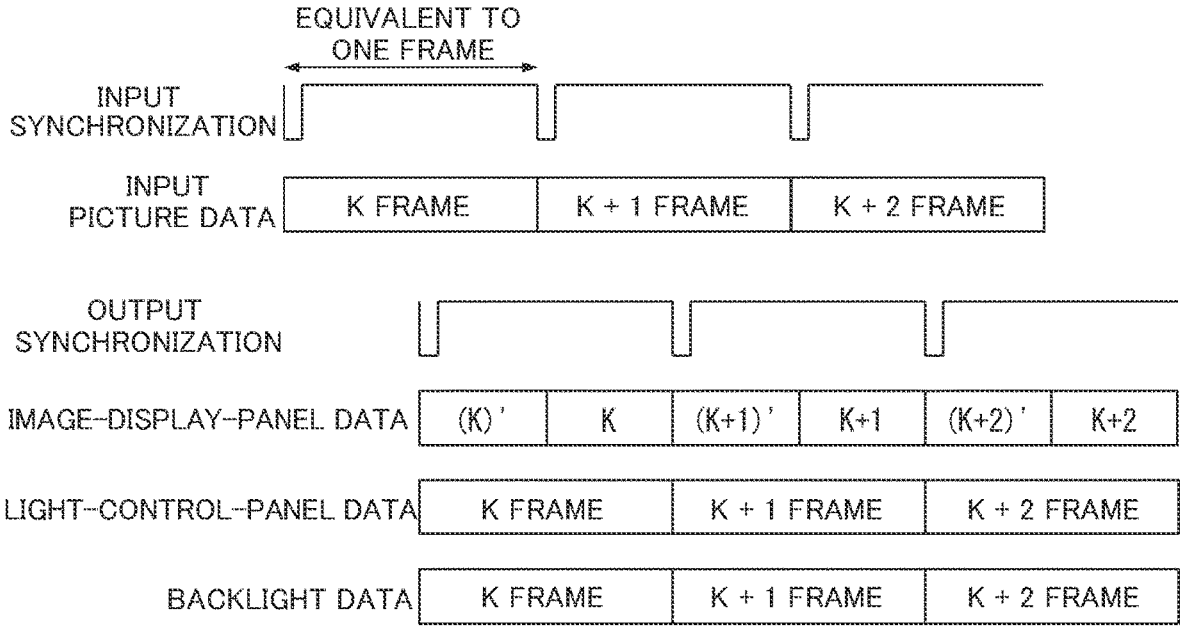
FIG. 18 is a timing diagram simplistically illustrating time points of various drive signals to be generated by the signal processor of the liquid crystal display device illustrated in FIG. 17.

FIG. 18 is a timing diagram simplistically illustrating time points of various drive signals to be generated by the signal processor 18 of the liquid crystal display device 1*b*.

As illustrated in FIG. 18, the input picture data includes, for example, a K frame, a K+1 frame, and a K+2 frame. In such a case, the signal processor 18 generates as light-control-panel data a signal including the K frame, the K+1 frame, and the K+2 frame, and outputs the generated signal.

Moreover, the signal processor 18 generates as backlight data a signal including the K frame, the K+1 frame, and the K+2 frame, and outputs the generated signal.

Meanwhile, as illustrated in FIG. 18, when the input picture data includes the K frame, the K+1 frame, and the K+2 frame, the signal processor 18 generates as image-display-panel data a signal including: two sub-frames into which a period of the K frame is divided; two sub-frames into which a period of the K+1 frame is divided; and two sub-frames into which a period of the K+2 frame is divided, and outputs the generated signal. As an example, the light-control-panel data may have different values between the two sub-frames included in a frame. More specifically, the image-display-panel data may have different signal values between a sub-frame K' and a sub-frame K included in the frame K.

As illustrated in FIG. 18, the image-display-panel data has different signal values between the two sub-frames; namely, the sub-frame K' and the sub-frame K into which the K frame is divided. Likewise, the image-display-panel data has different signal values between two sub-frames; namely, a sub-frame (K+1)' and a sub-frame K+1 into which the K+1 frame is divided. Likewise, the image-display-panel data has different signal values between two sub-frames; namely, a sub-frame (K+2)' and a sub-frame K+2 into which the K+2 frame is divided.

Figure 19:
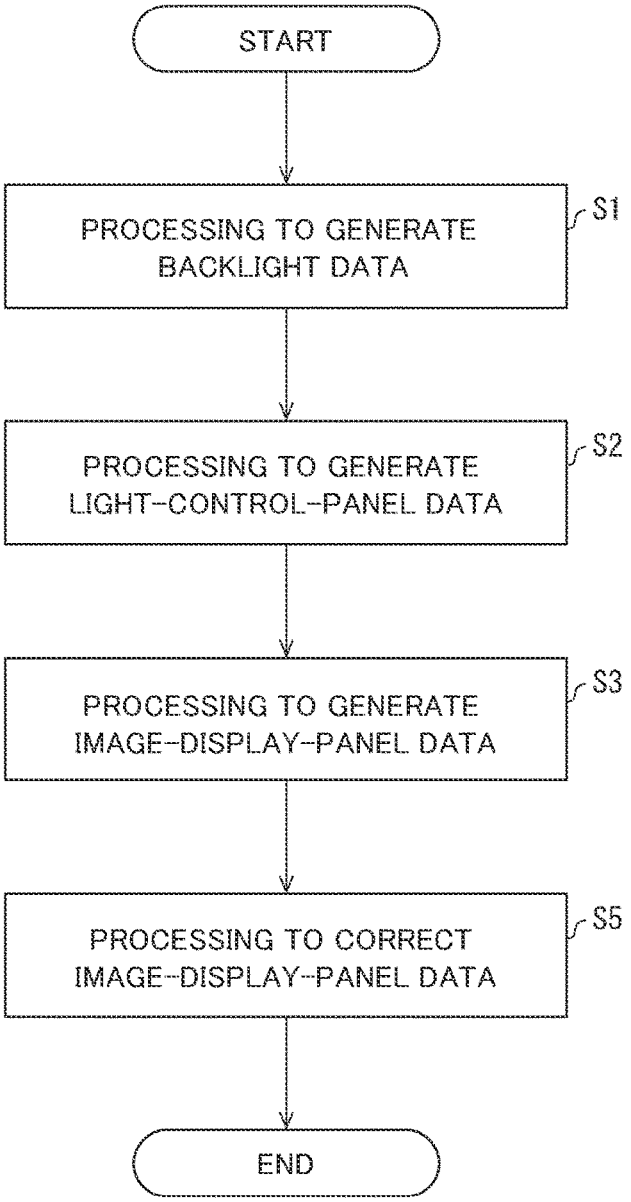
FIG. 19 is a flowchart of processing executed by the signal processor and a display-panel-signal corrector of the liquid crystal display device illustrated in FIG. 17.

Flowchart of Processing Executed by Signal Processor and Display-Panel-Signal Corrector FIG. 19 is a flowchart of processing executed by the signal processor 18 and the display-panel-signal corrector 187 of the liquid crystal display device 1*b* illustrated in FIG. 17.

The processing at Steps S1 to S3 in FIG. 19 is the same as the processing at Steps S1 to S3 in FIGS. 3 and 8, and the details of the processing will be omitted. At Step S5, the display-panel-signal corrector 187 executes processing to correct the image-display-panel data in accordance with the light-control-panel data.

Flowchart of Processing Executed by Display-Panel-Signal Corrector

Figure 20:
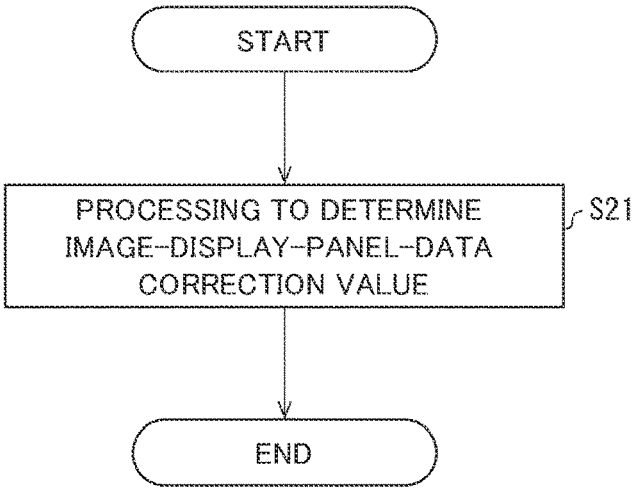
FIG. 20 is a flowchart of processing executed by the display-panel-signal corrector of the liquid crystal display device illustrated in FIG. 17.

FIG. 20 is a flowchart (a second flowchart) of processing executed by the display-panel-signal corrector 187 of the liquid crystal display device 1*b* illustrated in FIG. 17. More specifically, the flowchart in FIG. 20 shows details of the processing at Step S5 in FIG. 19.

As shown in FIG. 20, at Step S21, the display-panel-signal corrector 187 determines one of such four cases as drive examples 1 to 4 to be described below in this embodiment. For each of the pixels in the image display panel 12, one of the four cases is determined from the light-control-panel data and the image-display-panel data. In accordance with each of the cases, the display-panel-signal corrector 187 executes processing to correct the image-display-panel data.

Note that, in this embodiment, the light-control panel 13 is lower in resolution than the image display panel 12. Accordingly, for a pixel in the image display panel 12, an other pixel, in the light-control panel 13, corresponding to the pixel in the image display panel 12 is uniquely determined. Hence, unlike the second embodiment, it is not necessary in this embodiment to determine a representative value.

Figure 21:
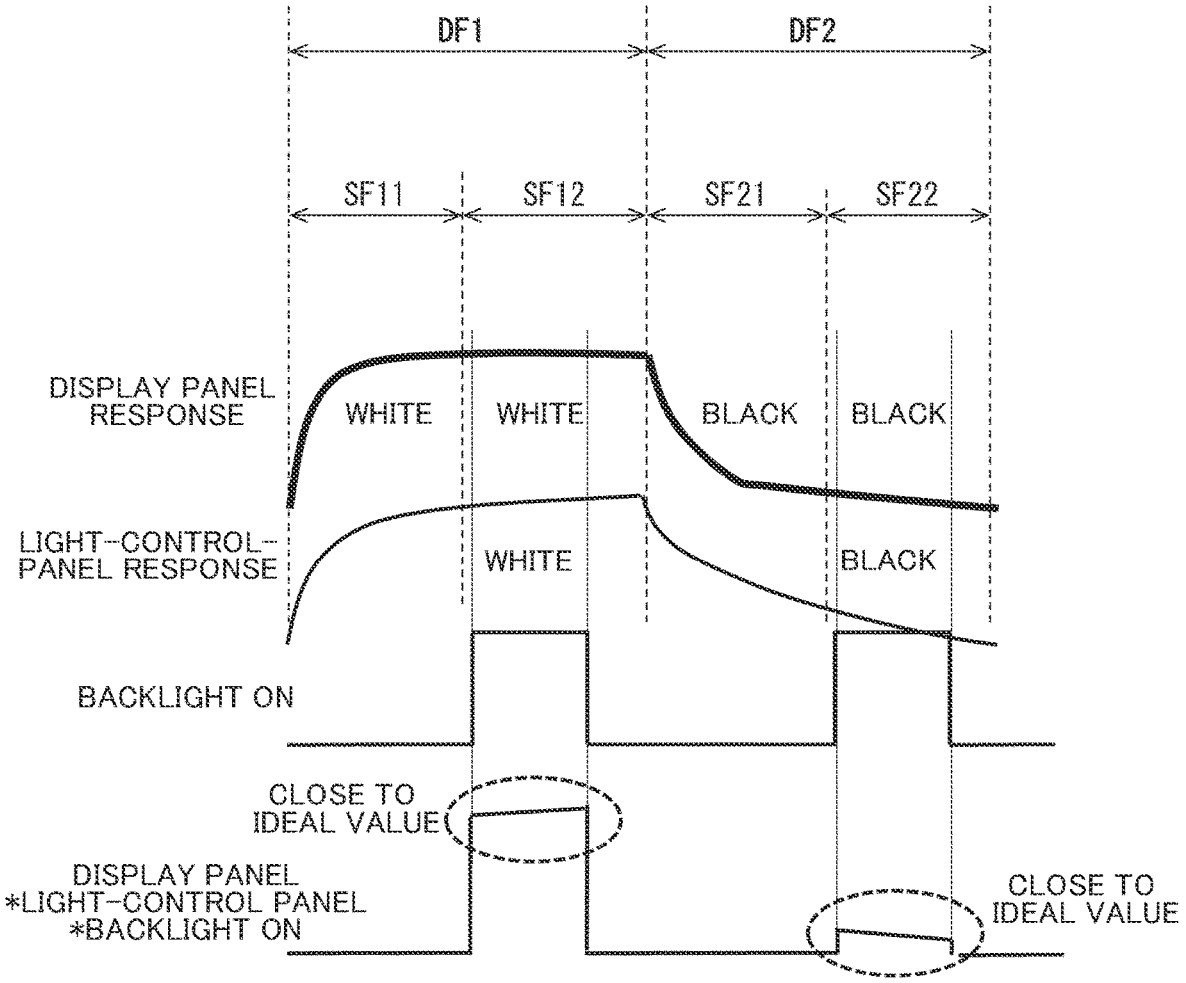
FIG. 21 is a timing diagram illustrating responsivities of the first liquid crystal panel and the second liquid crystal panel when the signal processor generates the various drive signals as seen in FIG. 18.

FIG. 21 is a timing diagram illustrating responsivities of the image display panel 12 and the light-control panel 13 when the signal processor 18 according to the third embodiment generates the various drive signals as seen in FIG. 18.

As illustrated in FIG. 21, the light-control panel 13 is driven at a frame rate including a DF1 and a DF2 as frame periods. Likewise, the backlight 11 is also driven at a frame rate including the DF1 and the DF2 as frame periods.

Meanwhile, the image display panel 12 is driven at a frame rate including: two sub frame-periods SF11 and SF12 into which the frame period DF1 is divided; and two sub frame-periods SF21 and SF22 into which the frame period DF2 is divided. Hence, as an example in this embodiment, the image display panel 12 is driven at a refresh rate twice as high as a refresh rate of the light-control panel 13.

As can be seen, the image display panel 12 is driven at a refresh rate higher than a refresh rate of the light-control panel 13. Accordingly, during one frame period of the light-control panel 13, the image display panel 12 is driven multiple times, improving the responsivity of the image display panel 12.

More specifically, as illustrated in FIG. 21, the image display panel 12 is driven at the frame rates including the sub frame-periods SF11 and SF12 and the sub frame-periods SF21 and SF22. Hence, the image display panel 12 can exhibit such responsivity as quick power-up and power-down.

As a result, as illustrated in FIG. 21, an index; that is, the product of a responsivity of the image display panel 12, a responsibility of the light-control panel 13, and a responsibility of the turn-on of the backlight, is close to an ideal value (a theoretical value).

Described below in detail are specific drive examples of this embodiment, with reference to FIGS. 22 to 25.

Drive Example 1

Figure 22:
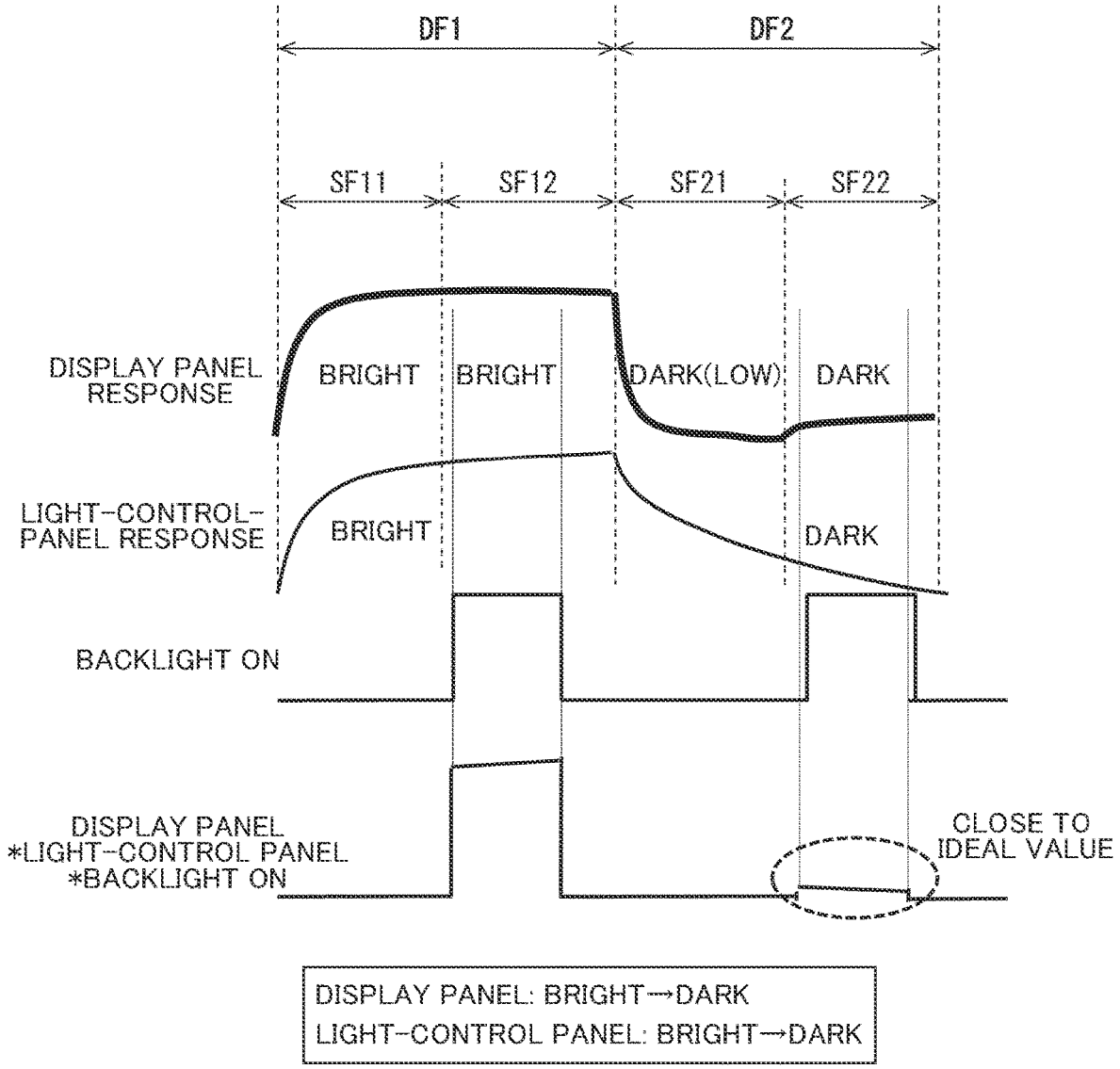
FIG. 22 is a diagram illustrating a drive example 1 by a driver of the liquid crystal display device illustrated in FIG. 17.

FIG. 22 is a diagram illustrating a drive example 1 by a driver; specifically, the display-panel-signal corrector 187, of the liquid crystal display device 1*b* illustrated in FIG. 17.

FIG. 22 shows the drive example 1. When the display-panel-signal corrector 187 (i) supplies a pixel, included in the image display panel 12, with a signal having a grayscale value lower in the second frame DF2 than in the first frame DF1, the second frame DF2 immediately succeeding the first frame DF1, and (ii) supplies an other pixel, included in the light-control panel 13 and corresponding to the pixel in the image display panel 12, with a signal having a grayscale value lower in the second frame DF2 than in the first frame DF1, the display-panel-signal corrector 187 generates, for the pixel in the image display panel 12, a signal (i.e. corrected display-panel data) corrected to have a grayscale value lower in the first sub-frame SF21, included in the second frame DF2, than in the second sub-frame SF22 succeeding the first sub-frame SF21 (Step S5 in FIG. 19 and Step S21 in FIG. 20), and supplies the generated signal to the pixel in the image display panel 12.

Generally, it takes a certain time period until the light-control panel 13 reaches a target dark state. In this drive example, the image display panel 12 has two kinds of transmittance set for the first sub-frame (e.g. the sub-frame SF21) and the second sub-frame (e.g., the sub-frame SF22) included in a frame (e.g. the frame DF2). In this drive example, the image display panel 12 is controlled in the first sub-frame SF21 to be darker than the image-display-panel data before correction indicates, and is driven in the second sub-frame SF22 in the dark state as indicated by the image-display-panel data before correction.

The driver 10 drives the image display panel 12 as described above, and allows the liquid crystal display device 1*b* to achieve more beneficially a display condition close to an ideal value (a theoretical value).

Drive Example 2

Figure 23:
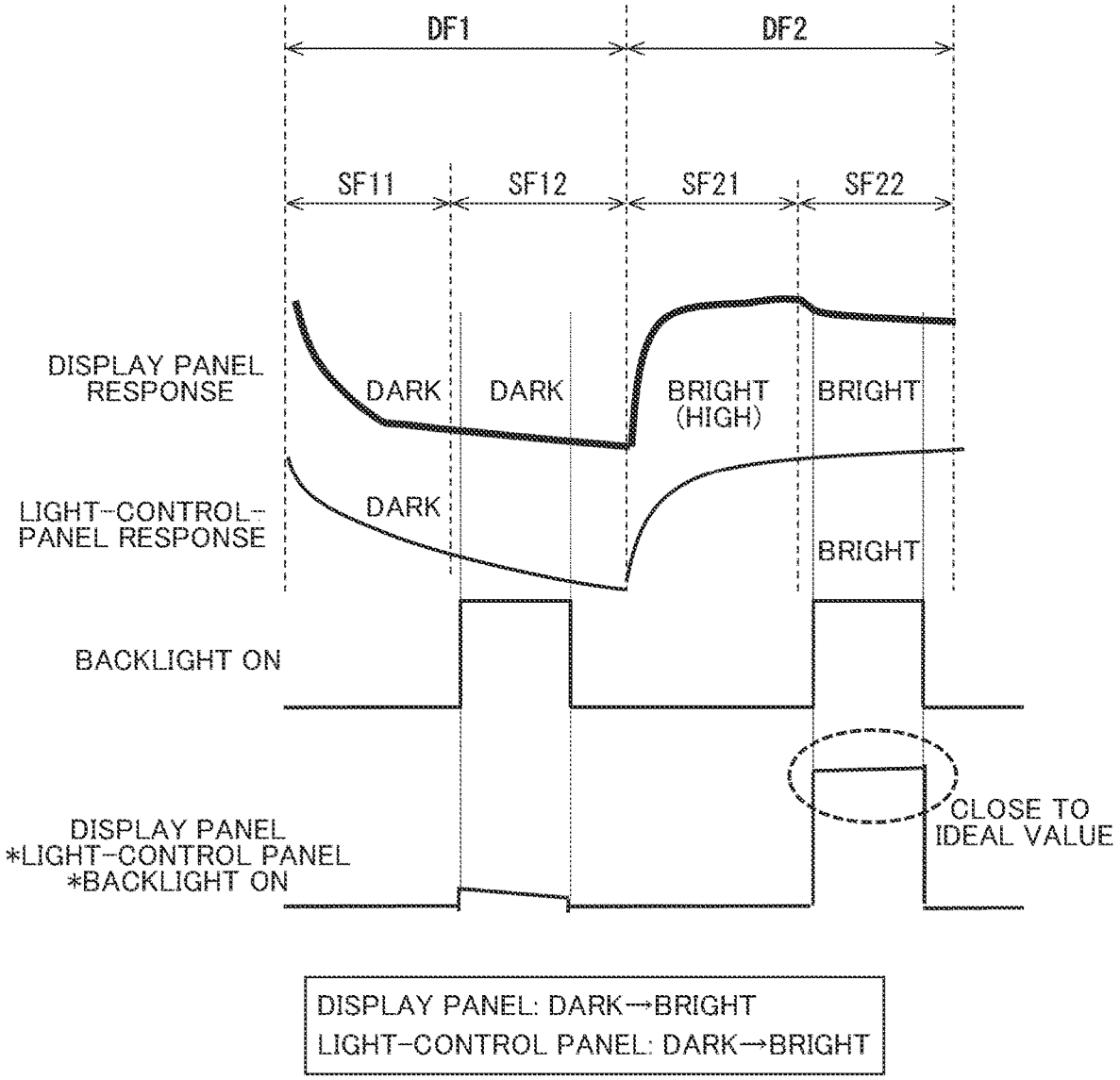
FIG. 23 is a diagram illustrating a drive example 2 by the driver of the liquid crystal display device illustrated in FIG. 17.

FIG. 23 is a diagram illustrating a drive example 2 by the driver; specifically, the display-panel-signal corrector 187, of the liquid crystal display device 1*b* illustrated in FIG. 17.

FIG. 23 shows the drive example 2. When the display-panel-signal corrector 187 (i) supplies a pixel, included in the image display panel 12, with a signal having a grayscale value higher in the second frame DF2 than in the first frame DF1, the second frame DF2 immediately succeeding the first frame DF1, and (ii) supplies an other pixel, included in the light-control panel 13 and corresponding to the pixel in the image display panel 12, with a signal having a grayscale value higher in the second frame DF2 than in the first frame DF1, the display-panel-signal corrector 187 generates, for the pixel in the image display panel 12, a signal (i.e. corrected display-panel data) corrected to have a grayscale value higher in the first sub-frame SF21, included in the second frame DF2, than in the second sub-frame SF22 succeeding the first sub-frame SF21 (Step S5 in FIG. 19 and Step S21 in FIG. 20), and supplies the generated signal to the pixel in the image display panel 12.

In this drive example, the image display panel 12 is controlled in the first sub-frame SF21 to be brighter than the image-display-panel data before correction indicates, and is driven in the second sub-frame SF22 in the bright state as indicated by the image-display-panel data before correction.

The driver 10 drives the image display panel 12 as described above, and allows the liquid crystal display device 1*b* to achieve more beneficially a display condition close to an ideal value (a theoretical value).

Drive Example 3

Figure 24:
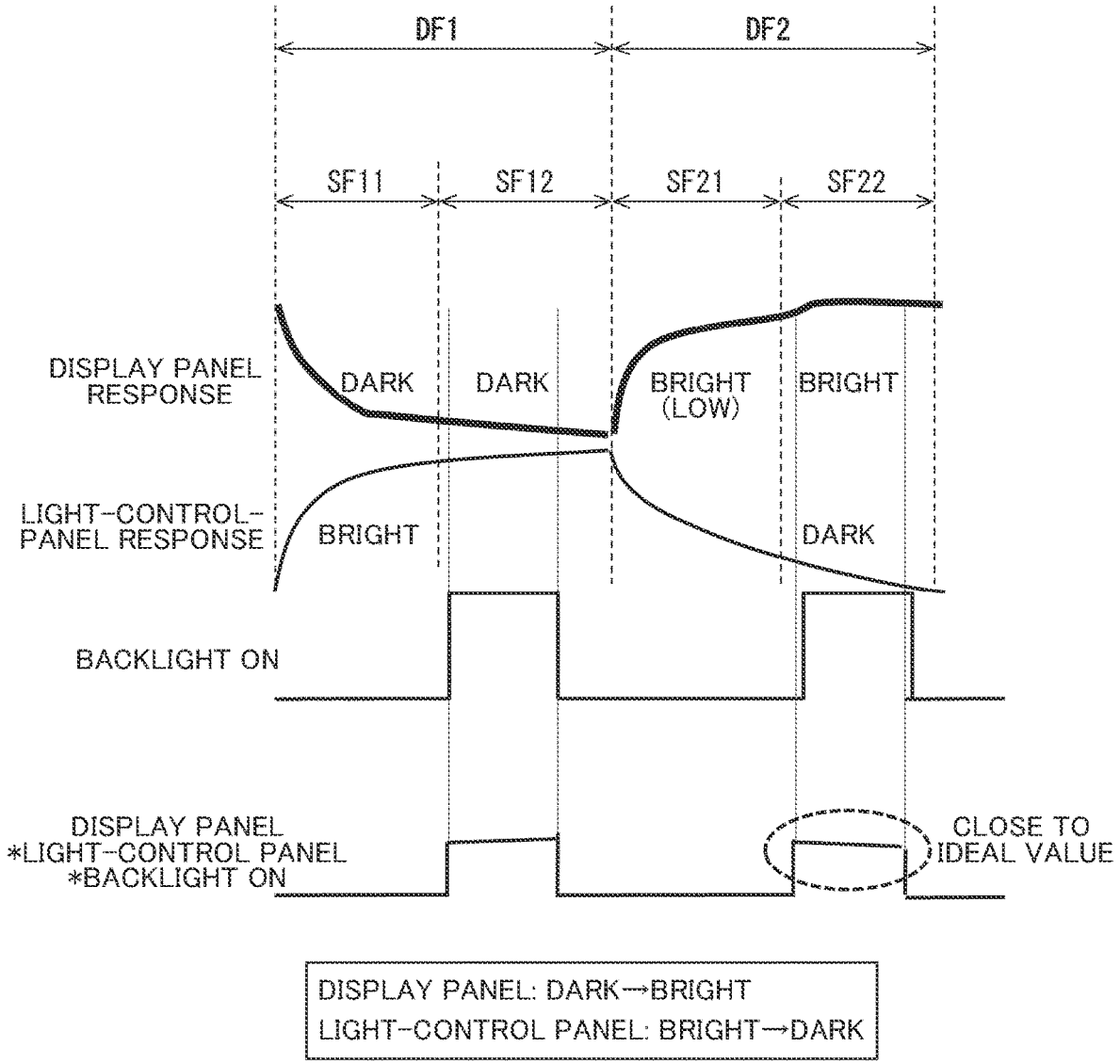
FIG. 24 is a diagram illustrating a drive example 3 by the driver of the liquid crystal display device illustrated in FIG. 17.

FIG. 24 is a diagram illustrating a drive example 3 by the driver; specifically, the display-panel-signal corrector 187, of the liquid crystal display device 1*b* illustrated in FIG. 17.

FIG. 24 shows the drive example 3. When the display-panel-signal corrector 187 (i) supplies a pixel, included in the image display panel 12, with a signal having a grayscale value higher in the second frame DF2 than in the first frame DF1, the second frame DF2 immediately succeeding the first frame DF1, and (ii) supplies an other pixel, included in the light-control panel 13 and corresponding to the pixel in the image display panel 12, with a signal having a grayscale value lower in the second frame DF2 than in the first frame DF1, the display-panel-signal connector 187 generates, for the pixel in the image display panel 12, a signal (i.e. corrected display-panel data) corrected to have a grayscale value lower in the first sub-frame SF21, included in the second frame DF2, than in the second sub-frame SF22 succeeding the first sub-frame SF21 (Step S5 in FIG. 19 and Step S21 in FIG. 20), and supplies the generated signal to the pixel in the image display panel 12.

In this drive example, the image display panel 12 is controlled in the first sub-frame SF21 to be darker than the image-display-panel data before correction indicates, and is driven in the second sub-frame SF22 in the bright state as indicated by the image-display-panel data before correction.

The driver 10 drives the image display panel 12 as described above, and allows the liquid crystal display device 1*b* to achieve more beneficially a display condition close to an ideal value (a theoretical value).

Drive Example 4

Figure 25:
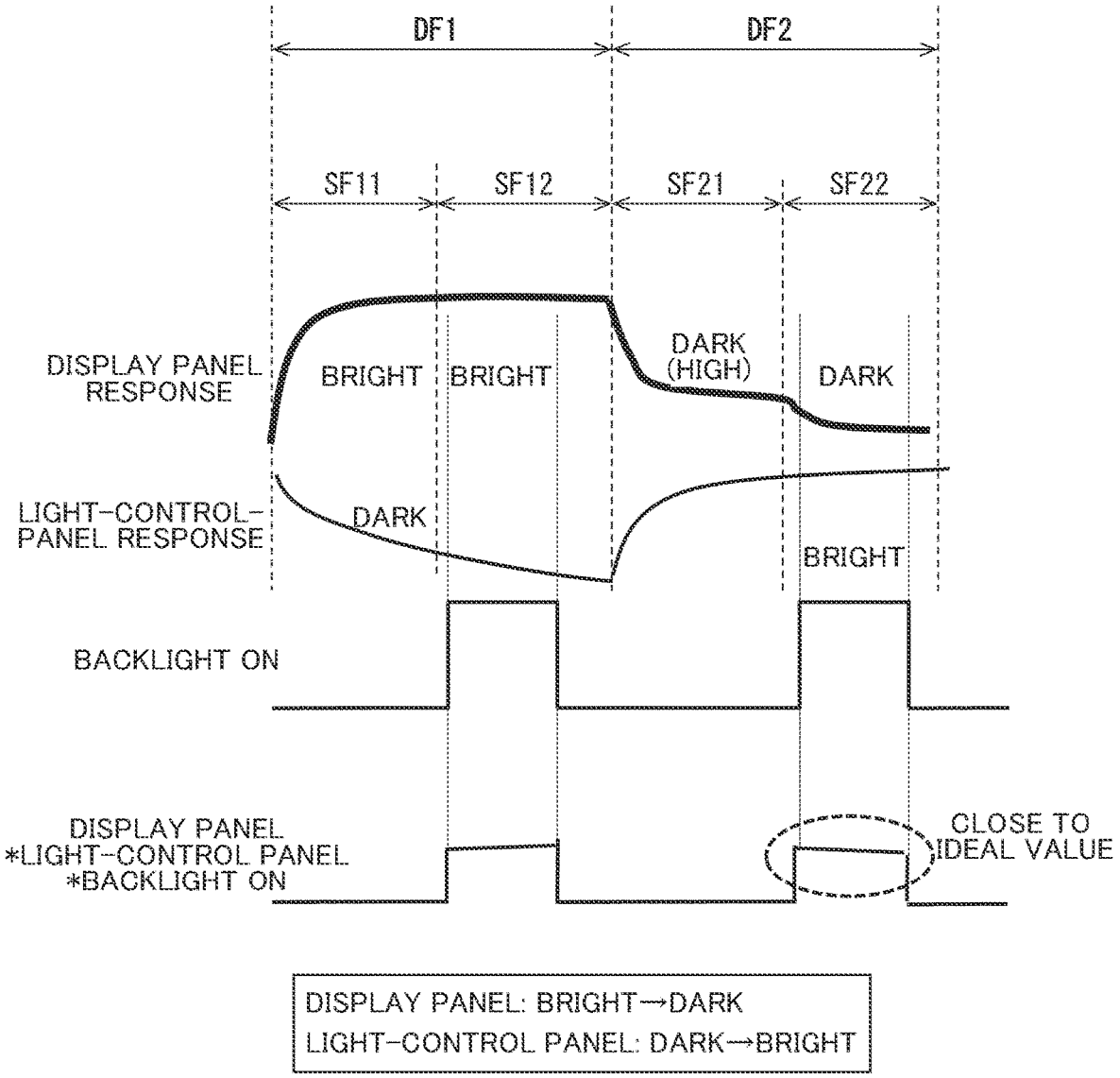
FIG. 25 is a diagram illustrating a drive example 4 by the driver of the liquid crystal display device illustrated in FIG. 17.

FIG. 25 is a diagram illustrating a drive example 4 by the driver; specifically, the display-panel-signal corrector 187, of the liquid crystal display device 1*b* illustrated in FIG. 17.

FIG. 25 shows the drive example 4. When the display-panel-signal corrector 187 (i) supplies a pixel, included in the image display panel 12, with a signal having a grayscale value lower in the second frame DF2 than in the first frame DF1, the second frame DF2 immediately succeeding the first frame DF1, and (ii) supplies an other pixel, included in the light-control panel 13 and corresponding to the pixel in the image display panel 12, with a signal having a grayscale value higher in the second frame DF2 than in the first frame DF1, the display-panel-signal corrector 187 generates, for the pixel in the image display panel 12, a signal (i.e. corrected display-panel data) corrected to have a grayscale value higher in the first sub-frame SF21, included in the second frame DF2, than in the second sub-frame SF22 succeeding the first sub-frame SF21 (Step S5 in FIG. 19 and Step S21 in FIG. 20), and supplies the generated signal to the pixel in the image display panel 12.

In this drive example, the image display panel 12 is controlled in the first sub-frame SF21 to be brighter than the image-display-panel data before correction indicates, and is driven in the second sub-frame SF22 in the dark state as indicated by the image-display-panel data before correction.

The driver 10 drives the image display panel 12 as described above, and allows the liquid crystal display device 1*b* to achieve more beneficially a display condition close to an ideal value (a theoretical value).

Software Implementation

The control blocks of the liquid crystal display device (particularly, the driver 10) may be implemented by logic circuits (hardware) fabricated, for example, in the form of an integrated circuit (IC chip) and may be implemented by software.

In the latter form of implementation, the liquid crystal display device 1 includes a computer that executes instructions from programs or software by which various functions are implemented. This computer includes among others at least one processor (controller) and at least one storage medium containing the programs in a computer-readable format. The processor in the computer then retrieves and runs the programs contained in the storage medium, thereby achieving the object of an aspect of the present invention. The processor may be, for example, a central processing unit (CPU). The storage medium may be a "non-transitory, tangible medium" such as a read-only memory (ROM), a tape, a disc/disk, a card, a semiconductor memory, or programmable logic circuitry. The liquid crystal display device 1 may further include, for example, a random access memory (RAM) for loading the programs. The programs may be supplied to the computer via any transmission medium (e.g., over a communications network or by broadcasting waves) that can transmit the programs. The present invention, in an aspect thereof, encompasses data signals on a carrier wave that are generated during electronic transmission of the programs.

SUMMARY

First Aspect

A liquid crystal display device (1, 1*a*, 1*b*) according to a first aspect of the present invention includes: a backlight (11); a first liquid crystal panel (12); a second liquid crystal panel (13) overlapped with the first liquid crystal panel, and disposed closer to the backlight than to the first liquid crystal panel; and a driver (10) configured to drive the backlight, the first liquid crystal panel, and the second liquid crystal panel. The second liquid crystal panel is lower in resolution than the first liquid crystal panel. The driver drives the first liquid crystal panel and the second liquid crystal panel at different refresh rates.

Second Aspect

In the liquid crystal display device (1, 1*a*) according to, for example, the first aspect, the driver drives the second liquid crystal panel at a refresh rate higher than a refresh rate of the first liquid crystal panel.

Third Aspect

In the liquid crystal display device (1, 1*a*) according to, for example, the first or the second aspect, the driver determines pixel values of a plurality of pixels included in the second liquid crystal panel, with reference to pixel values of a plurality of pixels included in the first liquid crystal panel and corresponding to the pixels in the second liquid crystal panel.

Fourth Aspect

In the liquid crystal display device (1*a*) according to, for example, the first to third aspects, the driver drives the second liquid crystal panel to compensate for a response speed of the first liquid crystal panel.

Fifth Aspect

In the liquid crystal display device (1*a*) according to, for example, the fourth aspect, when the driver: (i) supplies a pixel, included in the first liquid crystal panel, with a signal having a grayscale value lower in a second frame than in a first frame, the second frame immediately succeeding the first frame, and (ii) supplies an other pixel, included in the second liquid crystal panel and corresponding to the pixel in the first liquid crystal panel, with a signal having a grayscale value lower in the second frame than in the first frame, the driver supplies the other pixel, included in the second liquid crystal panel and corresponding to the pixel in the first liquid crystal panel, with a signal having a grayscale value lower in a first sub-frame, included in the second frame, than in a second sub-frame succeeding the first sub-frame.

Sixth Aspect

In the liquid crystal display device (1*a*) according to, for example, the fourth or the fifth aspect, when the driver: (i) supplies a pixel, included in the first liquid crystal panel, with a signal having a grayscale higher in a second frame than in a first frame, the second frame immediately succeeding the first frame, and (ii) supplies an other pixel, included in the second liquid crystal panel and corresponding to the pixel in the first liquid crystal panel, with a signal having a grayscale value higher in the second frame than in the first frame, the driver supplies the other pixel, included in the second liquid crystal panel and corresponding to the pixel in the first liquid crystal panel, with a signal having a grayscale value higher in a first sub-frame, included in the second frame, than in a second sub-frame succeeding the first sub-frame.

Seventh Aspect

In the liquid crystal display device (1*a*) according to, for example, any one of the fourth to sixth aspects, when the driver: (i) supplies a pixel, included in the first liquid crystal panel, with a signal having a grayscale value lower in a second frame than in a first frame, the second frame immediately succeeding the first frame, and (ii) supplies an other pixel, included in the second liquid crystal panel and corresponding to the pixel in the first liquid crystal panel, with a signal having a grayscale value higher in the second frame than in the first frame, the driver supplies the other pixel, included in the second liquid crystal panel and corresponding to the pixel in the first liquid crystal panel, with a signal having a grayscale value lower in a first sub-frame, included in the second frame, than in a second sub-frame succeeding the first sub-frame.

Eighth Aspect

In the liquid crystal display device (1*a*) according to, for example, any one of the fourth to seventh aspects, when the driver: (i) supplies a pixel, included in the first liquid crystal panel, with a signal having a grayscale value higher in a second frame than in a first frame, the second frame immediately succeeding the first frame, and (ii) supplies an other pixel, included in the second liquid crystal panel and corresponding to the pixel in the first liquid crystal panel, with a signal having a grayscale value lower in the second frame than in the first frame, the driver supplies the other pixel, included in the second liquid crystal panel and corresponding to the pixel in the first liquid crystal panel, with a signal having a grayscale value higher in a first sub-frame, included in the second frame, than in a second sub-frame succeeding the first sub-frame.

Ninth Aspect

In the liquid crystal display device (1*b*) according to, for example, the first aspect, the driver drives the first liquid crystal panel at a refresh rate higher than a refresh rate of the second liquid crystal panel.

Tenth Aspect

In the liquid crystal display device (1*b*) according to, for example, the ninth aspect, the driver drives the first liquid crystal panel to compensate for a response speed of the second liquid crystal panel.

Eleventh Aspect

In the liquid crystal display device (1*b*) according to, for example, the tenth aspect, when the driver: (i) supplies a pixel, included in the first liquid crystal panel, with a signal having a grayscale value lower in a second frame than in a first frame, the second frame immediately succeeding the first frame, and (ii) supplies an other pixel, included in the second liquid crystal panel and corresponding to the pixel in the first liquid crystal panel, with a signal having a grayscale value lower in the second frame than in the first frame, the driver supplies the pixel in the first liquid crystal panel with a signal having a grayscale value lower in a first sub-frame, included in the second frame, than in a second sub-frame succeeding the first sub-frame.

Twelfth Aspect

In the liquid crystal display device (1*b*) according to, for example, the tenth or the eleventh aspect, when the driver: (i) supplies a pixel, included in the first liquid crystal panel, with a signal having a grayscale value higher in a second frame than in a first frame, the second frame immediately succeeding the first frame, and (ii) supplies an other pixel, included in the second liquid crystal panel and corresponding to the pixel in the first liquid crystal panel, with a signal having a grayscale value higher in the second frame than in the first frame, the driver supplies the pixel in the first liquid crystal panel with a signal having a grayscale value higher in a first sub-frame, included in the second frame, than in a second sub-frame succeeding the first sub-frame.

Thirteenth Aspect

In the liquid crystal display device (1*b*) according to, for example, the tenth aspect, when the driver: (i) supplies a pixel, included in the first liquid crystal panel, with a signal having a grayscale value higher in a second frame than in a first frame, the second frame immediately succeeding the first frame, and (ii) supplies an other pixel, included in the second liquid crystal panel and corresponding to the pixel in the first liquid crystal panel, with a signal having a grayscale value lower in the second frame than in the first frame, the driver supplies the pixel in the first liquid crystal panel with a signal having a grayscale value lower in a first sub-frame, included in the second frame, than in a second sub-frame succeeding the first sub-frame.

Fourteenth Aspect

In the liquid crystal display device (1*b*) according to, for example, the tenth or the eleventh aspect, when the driver: (i) supplies a pixel, included in the first liquid crystal panel, with a signal having a grayscale value lower in a second frame than in a first frame, the second frame immediately succeeding the first frame, and (ii) supplies an other pixel, included in the second liquid crystal panel and corresponding to the pixel in the first liquid crystal panel, with a signal having a grayscale value higher in the second frame than in the first frame, the driver supplies the pixel in the first liquid crystal panel with a signal having a grayscale value higher in a first sub-frame, included in the second frame, than in a second sub-frame succeeding the first sub-frame.

The present invention shall not be limited to the embodiments described above, and can be modified in various manners within the scope of claims. The technical aspects disclosed in different embodiments are to be appropriately combined together to implement an other embodiment. Such an embodiment shall be included within the technical scope of the present invention. Moreover, the technical aspects disclosed in each embodiment may be combined to achieve a new technical feature.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A liquid crystal display device, comprising:

a backlight;

a first liquid crystal panel;

a second liquid crystal panel overlapped with the first liquid crystal panel, and disposed closer to the backlight than to the first liquid crystal panel; and a driver configured to drive the backlight, the first liquid crystal panel, and the second liquid crystal panel, and the second liquid crystal panel being lower in resolution than the first liquid crystal panel, wherein the driver drives the second liquid crystal panel at a refresh rate higher than a refresh rate of the first liquid crystal panel, and the driver drives the second liquid crystal panel to compensate for a response speed of the first liquid crystal panel.

2. The liquid crystal display device according to claim 1, wherein the driver determines pixel values of a plurality of pixels included in the second liquid crystal panel, with reference to pixel values of a plurality of pixels included in the first liquid crystal panel and corresponding to the pixels in the second liquid crystal panel.

3. The liquid crystal display device according to claim 1, wherein when the driver:

(i) supplies a pixel, included in the first liquid crystal panel, with a signal having a grayscale value lower in a second frame than in a first frame, the second frame immediately succeeding the first frame, and (ii) supplies an other pixel, included in the second liquid crystal panel and corresponding to the pixel in the first liquid crystal panel, with a signal having a grayscale value lower in the second frame than in the first frame, the driver supplies the other pixel, included in the second liquid crystal panel and corresponding to the pixel in the first liquid crystal panel, with a signal having a grayscale value lower in a first sub-frame, included in the second frame, than in a second sub-frame succeeding the first sub-frame.

4. The liquid crystal display device according to claim 1, wherein when the driver:

(i) supplies a pixel, included in the first liquid crystal panel, with a signal having a grayscale higher in a second frame than in a first frame, the second frame immediately succeeding the first frame, and (ii) supplies an other pixel, included in the second liquid crystal panel and corresponding to the pixel in the first liquid crystal panel, with a signal having a grayscale value higher in the second frame than in the first frame, the driver supplies the other pixel, included in the second liquid crystal panel and corresponding to the pixel in the first liquid crystal panel, with a signal having a grayscale value higher in a first sub-frame, included in the second frame, than in a second sub-frame succeeding the first sub-frame.

5. The liquid crystal display device according to claim 1, wherein when the driver:

(i) supplies a pixel, included in the first liquid crystal panel, with a signal having a grayscale value lower in a second frame than in a first frame, the second frame immediately succeeding the first frame, and (ii) supplies an other pixel, included in the second liquid crystal panel and corresponding to the pixel in the first liquid crystal panel, with a signal having a grayscale value higher in the second frame than in the first frame, the driver supplies the other pixel, included in the second liquid crystal panel and corresponding to the pixel in the first liquid crystal panel, with a signal having a grayscale value lower in a first sub-frame, included in the second frame, than in a second sub-frame succeeding the first sub-frame.

6. The liquid crystal display device according to claim 1, wherein when the driver:

(i) supplies a pixel, included in the first liquid crystal panel, with a signal having a grayscale value higher in a second frame than in a first frame, the second frame immediately succeeding the first frame, and (ii) supplies an other pixel, included in the second liquid crystal panel and corresponding to the pixel in the first liquid crystal panel, with a signal having a grayscale value lower in the second frame than in the first frame, the driver supplies the other pixel, included in the second liquid crystal panel and corresponding to the pixel in the first liquid crystal panel, with a signal having a grayscale value higher in a first sub-frame, included in the second frame, than in a second sub-frame succeeding the first sub-frame.

7. The liquid crystal display device according to claim 1, wherein in a case where a plurality of sub-frames dividing a first frame that are input to the first liquid crystal panel are input to the second liquid crystal panel, the backlight is controlled to turn on during a period when a last sub-frame of the plurality of sub-frames is input to the second liquid crystal panel.

8. The liquid crystal display device according to claim 1, wherein in a case where two sub-frames dividing a first frame that are input to the first liquid crystal panel are input to the second liquid crystal panel, the backlight is controlled to turn on during a period when a second sub-frame of the two sub-frames is input to the second liquid crystal panel.

9. A liquid crystal display device, comprising:

a backlight;

a first liquid crystal panel;

a second liquid crystal panel overlapped with the first liquid crystal panel, and disposed closer to the backlight than to the first liquid crystal panel; and a driver configured to drive the backlight, the first liquid crystal panel, and the second liquid crystal panel, the second liquid crystal panel being lower in resolution than the first liquid crystal panel, and the driver driving the first liquid crystal panel and the second liquid crystal panel at different refresh rates, wherein the driver drives the second liquid crystal panel to compensate for a response speed of the first liquid crystal panel, and when the driver:

(i) supplies a pixel, included in the first liquid crystal panel, with a signal having a grayscale value lower in a second frame than in a first frame, the second frame immediately succeeding the first frame, and (ii) supplies an other pixel, included in the second liquid crystal panel and corresponding to the pixel in the first liquid crystal panel, with a signal having a grayscale value lower in the second frame than in the first frame, the driver supplies the other pixel, included in the second liquid crystal panel and corresponding to the pixel in the first liquid crystal panel, with a signal having a grayscale value lower in a first sub-frame, included in the second frame, than in a second sub-frame succeeding the first sub-frame.

10. A liquid crystal display device, comprising:

a backlight;

a first liquid crystal panel;

a second liquid crystal panel overlapped with the first liquid crystal panel, and disposed closer to the backlight than to the first liquid crystal panel; and a driver configured to drive the backlight, the first liquid crystal panel, and the second liquid crystal panel, the second liquid crystal panel being lower in resolution than the first liquid crystal panel, and the driver driving the first liquid crystal panel and the second liquid crystal panel at different refresh rates, wherein the driver drives the second liquid crystal panel to compensate for a response speed of the first liquid crystal panel, and when the driver:

(i) supplies a pixel, included in the first liquid crystal panel, with a signal having a grayscale value higher in a second frame than in a first frame, the second frame immediately succeeding the first frame, and (ii) supplies an other pixel, included in the second liquid crystal panel and corresponding to the pixel in the first liquid crystal panel, with a signal having a grayscale value higher in the second frame than in the first frame, the driver supplies the other pixel, included in the second liquid crystal panel and corresponding to the pixel in the first liquid crystal panel, with a signal having a grayscale value higher in a first sub-frame, included in the second frame, than in a second sub-frame succeeding the first sub-frame.

* * * * *